US007102574B2

(12) United States Patent
Otaka et al.

(10) Patent No.: US 7,102,574 B2
(45) Date of Patent: Sep. 5, 2006

(54) ANTENNA DEVICE AND METHOD FOR MANUFACTURING THE SAME

(75) Inventors: Naoki Otaka, Komaki (JP); Shigeya Aoyama, Komaki (JP); Noriyasu Sugimoto, Kohnan (JP)

(73) Assignee: NGK Spark Plug Co., Ltd., Aichi (JP)

( * ) Notice: Subject to any disclaimer, the term of this patent is extended or adjusted under 35 U.S.C. 154(b) by 77 days.

(21) Appl. No.: 10/889,180

(22) Filed: Jul. 13, 2004

(65) Prior Publication Data

US 2005/0030230 A1 Feb. 10, 2005

(30) Foreign Application Priority Data

Jul. 14, 2003 (JP) ..... P. 2003-196496
Jun. 17, 2004 (JP) ..... P. 2004-179987

(51) Int. Cl.
*H01Q 1/38* (2006.01)

(52) U.S. Cl. ..... 343/700 MS; 343/824; 343/844; 343/908

(58) Field of Classification Search ..... 343/824, 343/844, 908, 700 MS
See application file for complete search history.

(56) References Cited

U.S. PATENT DOCUMENTS 4,684,952 A * 8/1987 Munson et al. ..... 343/700 MS
5,633,646 A * 5/1997 Strickland ..... 343/700 MS
5,691,732 A * 11/1997 Tsuru et al. ..... 343/745
6,198,437 B1 * 3/2001 Watson et al. ..... 343/700 MS
6,218,990 B1 * 4/2001 Grangeat et al. .... 343/700 MS
6,380,895 B1 * 4/2002 Moren et al. ..... 343/700 MS
6,408,190 B1 6/2002 Ying
6,683,573 B1 * 1/2004 Park ..... 343/700 MS
6,700,543 B1 * 3/2004 Konishi et al. ..... 343/700 MS
6,914,561 B1 * 7/2005 Kuroda et al. ..... 343/700 MS
6,917,334 B1 * 7/2005 Chen ..... 343/700 MS
2002/0101382 A1 8/2002 Konishi et al.
2002/0113736 A1 8/2002 Toutain et al.
2002/0163470 A1 11/2002 Nagumo et al.
2002/0167446 A1 * 11/2002 Goto et al. ..... 343/700 MS
2003/0058176 A1 3/2003 Keilen et al.

FOREIGN PATENT DOCUMENTS

EP 0 634 808 A1 1/1995
EP 0 762 533 A2 12/1997
GB 2 316 233 A 2/1998

OTHER PUBLICATIONS

European Search Report dated Oct. 14, 2004.

* cited by examiner

*Primary Examiner*—Wilson Lee
*Assistant Examiner*—Marie Antoinette Cabucos
(74) *Attorney, Agent, or Firm*—Sughrue Mion, PLLC

(57) ABSTRACT

An antenna device comprising: a substrate; a radiation portion including a dielectric block arranged on one principal face of said substrate and a first conductor layer formed in a stereoscopic shape on a surface of said dielectric block; and a grounding conductor including a second conductor layer provided on other principal face of said substrate.

23 Claims, 35 Drawing Sheets

| SPECIFIC DIELECTRIC CONSTANT εr | BAND GHz |
|---|---|
| 13 | 8 |
| 15 | 7.6 |
| 21 | 5.5 |
| 34 | 3.1 |
| 45 | 2.3 |

| θ | VSWR MAX |
|---|---|
| 0 | 1.9412 |
| 10 | 1.8813 |
| 20 | 1.7381 |
| 30 | 1.7804 |
| 40 | 1.8488 |
| 50 | 1.9791 |
| 60 | 2.4116 |

| | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| 45mm | 3200 | 2970 | 12000 | 12000 |
| 70mm | 3240 | 3020 | 11000 | 11000 |
| 100mm | 3190 | 2970 | 11000 | 11000 |
| SPEC | 3100 | 3100 | 10600 | 10600 |

FREQ. (0.00 to 12.00GHz)

| | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| 30mm | 3280 | 3140 | 12000 | 12000 |
| 40mm | 3200 | 2970 | 12000 | 12000 |
| 50mm | 3860 | 3420 | 12000 | 12000 |
| SPEC | 3100 | 3100 | 10600 | 10600 |

FREQ. (0.00 to 12.00GHz)

| d1 | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| 2mm | 3200 | 2970 | 12000 | 12000 |
| 9mm | 3540 | 3390 | 7830 | 8600 |
| 16mm(center) | 3630 | 3510 | 5170 | 5420 |
| SPEC | 3100 | 3100 | 10600 | 10600 |

FREQ. (0.00 to 12.00GHz)

| d2 | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| 0mm | 5130 | 4710 | 6940 | 7370 |
| 1mm | 3200 | 2970 | 12000 | 12000 |
| 2mm | 2880 | 2730 | 6190 | 6590 |
| SPEC | 3100 | 3100 | 10600 | 10600 |

FREQ. (0.00 to 12.00GHz)

| | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| 6TH EMBODIMENT | 3170 | 2950 | 6840 | 12000 |
| 7TH EMBODIMENT | 3080 | 2900 | 6580 | 12000 |
| 8TH EMBODIMENT | 3270 | 3010 | 6930 | 12000 |
| SPEC | 3100 | 3100 | 10600 | 10600 |

FREQ. (0.00 to 12.00GHz)

| | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| 6TH EMBODIMENT | 3170 | 2950 | 6840 | 12000 |
| 9TH EMBODIMENT | 3210 | 2980 | 6740 | 12000 |
| 10TH EMBODIMENT | 3020 | 2850 | 12000 | 12000 |
| SPEC | 3100 | 3100 | 10600 | 10600 |

FREQ. (0.00 to 12.00GHz)

| | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| 6TH EMBODIMENT | 3170 | 2950 | 6840 | 12000 |
| 11TH EMBODIMENT | 3190 | 2960 | 6830 | 12000 |
| SPEC | 3100 | 3100 | 10600 | 10600 |

FREQ. (0.00 to 12.00GHz)

| | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| UPPER OPEN TYPE | 3140 | 3040 | 10820 | 10930 |
| LOWER OPEN TYPE | 3040 | 2920 | 7400 | 7700 |
| SPEC | 3100 | 3100 | 10600 | 10600 |

FREQ. (0.00 to 12.00GHz)

| | LOWER LIMIT FREQUENCY (MHz) | | UPPER LIMIT FREQUENCY (MHz) | |
|---|---|---|---|---|
| | VSWR<2.2 | VSWR<2.5 | VSWR<2.2 | VSWR<2.5 |
| UPPER OPEN TYPE | 3200 | 2970 | 12000 | 12000 |
| LOWER OPEN TYPE | 3070 | 2890 | 11710 | 11910 |
| SPEC | 3100 | 3100 | 10600 | 10600 |

FREQ. (0.00 to 12.00GHz)
(θ=0°)

FREQ. (0.00 to 12.00GHz)
(θ=20°)

FREQ. (0.00 to 12.00GHz)
(θ=40°)

FREQ. (0.00 to 12.00GHz)
(θ=60°)

FIG. 57

| θ (deg) | d2 (mm) | LOWER LIMIT FREQUENCY (MHz) | UPPER LIMIT FREQUENCY (MHz) |
|---|---|---|---|
| 0 | 1.0 | 3550 | 12000 |
| 0 | 1.5 | 3200 | 12000 |
| 0 | 2.0 | 3000 | 12000 |
| 0 | 2.5 | 2880 | 12000 |
| 20 | 1.0 | 3420 | 12000 |
| 20 | 1.5 | 3140 | 12000 |
| 20 | 2.0 | 2970 | 12000 |
| 20 | 2.5 | 2840 | 12000 |
| 40 | 1.0 | 3320 | 12000 |
| 40 | 1.5 | 3060 | 12000 |
| 40 | 2.0 | 2910 | 12000 |
| 40 | 2.5 | 2800 | 6400 |
| 60 | 1.0 | 3220 | 12000 |
| 60 | 1.5 | 3060 | 6800 |
| 60 | 2.0 | 2910 | 6360 |
| 60 | 2.5 | 2810 | 6070 |
| | SPEC | 3100 | 10600 |

FREQ. (0.00 to 12.00GHz)
(θ=0°)

FREQ. (0.00 to 12.00GHz)
(θ=20°)

FREQ. (0.00 to 12.00GHz)
(θ=40°)

FIG. 64

| θ (deg) | d2(mm) | LOWER LIMIT FREQUENCY (MHz) | UPPER LIMIT FREQUENCY (MHz) |
|---|---|---|---|
| 0 | 2.0 | 3284 | 12000 |
| 0 | 2.2 | 3149 | 12000 |
| 0 | 2.4 | 2961 | 12000 |
| 0 | 2.6 | 2759 | 12000 |
| 20 | 2.0 | 3172 | 12000 |
| 20 | 2.2 | 3028 | 12000 |
| 20 | 2.4 | 2972 | 12000 |
| 20 | 2.6 | 2728 | 6625 |
| 40 | 2.0 | 3043 | 6911 |
| 40 | 2.2 | 2929 | 6625 |
| 40 | 2.4 | 2825 | 6449 |
| 40 | 2.6 | 2728 | 6394 |
| | SPEC | 3100 | 10600 |

ANTENNA DEVICE AND METHOD FOR MANUFACTURING THE SAME

FIELD OF THE INVENTION

The present invention relates to an antenna device and a method for manufacturing the device.

BACKGROUND OF THE INVENTION

In the related art, there has been developed a miniature antenna to be used for the communications of ultrashort waves. Especially in the communication standards called the UWB (Ultra-wideband), the communication rate can be raised, but the band to be used is usually as wide as 3.1 GHz to 10.6 GHz. Therefore, it has been desired to develop the antenna device, which can pick up electric waves of such wide range efficiently. In the related art, the biconical antenna or the discone antenna has been known as the antenna device having wideband frequency characteristics. In Japanese Patent No. 3,273,463, for example, there is disclosed a wideband antenna device using a semicircular radiation plate. With a view to reducing the size of the antenna device, moreover, there have been proposed antenna devices of various shapes to reduce the size of the wideband antenna such as a bow-tie antenna (JP-A-2002-135037).

SUMMARY OF THE INVENTION

In this antenna device, however, the biconical antenna or discone antenna has a large shape so that its use is difficult as an antenna device of the type mounted in a device. Moreover, the antennas disclosed in Japanese Patent No. 3,273,463 and JP-A-2002-135037 have complex shapes, and their occupied volumes are not small for the antenna device. Moreover, electrodes of various shapes are combined, but they are basically flat-shaped radiation electrodes. If the electrodes are narrowed, therefore, their band is also narrowed. Thus, the antenna device of the related art has found a limit in its miniaturization. Moreover, the flat-shaped conductor member protrudes by itself and may not retain a sufficient strength.

The invention contemplates to solve those problems and has an object to provide an antenna device, which is excellent in size reduction and mountability while retaining strength. Another object of the invention is to provide an antenna device, which can correspond to ultra-wide frequency bands while reducing the size of its antenna.

In order to achieve the above-specified objects, according to a first aspect of the invention, there is provided an antenna device comprising: a substrate; a radiation portion including a dielectric block arranged on one principal face of the substrate and a first conductor layer formed in a stereoscopic shape on the surface of the dielectric block; and a grounding conductor including a second conductor layer formed on the other principal face of the substrate. This antenna device may further comprises a feeder line extending over the principal face of the substrate, from a feeder portion disposed at one end of the first conductor layer. Moreover, the grounding conductor may also be formed on a partial region on the other principal face of the substrate, and the radiation portion may also be arranged on such a region on the one principal face as avoids the region having the grounding conductor formed.

According to a second aspect of the invention, there is provided an antenna device comprising: an antenna element including: a substrate; a radiation portion having a dielectric block arranged on one principal face of the substrate, and a first conductor layer formed in a stereoscopic shape on the surface of the dielectric block; a grounding conductor having a second conductor layer formed on the other principal face of the substrate; and a feeder line extended over one principal face of the substrate from a feeder portion disposed at one end of the first conductor layer. The grounding conductor is formed in a partial region of the other principal face of the substrate, and the radiation portion is arranged closer to the peripheral edge portion of the substrate and on the one principal face corresponding to the region avoiding the partial region having the grounding conductor formed. In this antenna device, the radiation portion may also be arranged closer to either one side of the substrate in a direction along the side portion of the grounding conductor opposed to the radiation portion across the substrate.

In the invention, the first conductor layer may also be formed on at least such three faces of the surface of the dielectric block as except a contact face to contact with the substrate. Moreover, the first conductor layer may also be formed continuously at a portion of such a contact face in the dielectric block as to contact with the substrate. Alternatively, the first conductor layer may also be formed on such a contact face of the surface of the dielectric block as to contact with the substrate and the faces being adjacent to the contact face.

In the invention, moreover, the first conductor layer may also be formed in a radial shape from the feeder portion disposed at one end of the first conductor layer toward the other end.

Moreover, the first conductor layer may also be formed in a radial shape from the feeder portion disposed at the edge portion of the first conductor layer away from the region having the grounding conductor formed.

The dielectric block in the invention may also be made of any of alumina, calcium titanate, magnesium titanate and barium titanate. Moreover, the dielectric block may also have a specific dielectric constant of 15 or less.

Moreover, the first conductor layer in the invention may also be formed in such a radial shape having a center angle of 80 degrees or more and 180 degrees or less with respect to a straight line joining the feeder portion disposed at one end of the first conductor layer and the other end of the first conductor layer.

Moreover, the grounding conductor in the invention may be further formed along the feeder line on one principal face of the substrate, and the feeder line may also construct a coplanar line.

According to another aspect of the invention, there is provided a method for manufacturing an antenna device, comprising: the step of forming a dielectric member into a predetermined shape; the step of forming a feeding electrode to act as an antenna feeding portion at a predetermined portion of the dielectric member; the step of forming a conductor on the surface of the dielectric member so that the conductor may be entirely formed into a stereoscopic shape from the position of the feeding electrode backward from the dielectric member; and the step of arranging the dielectric member having the conductor formed, on the other principal face of the substrate having a grounding conductor formed.

According to the invention, it is possible to realize both the size reduction and the range widening of an antenna.

BRIEF DESCRIPTION OF THE DRAWINGS

FIG. 57 is a diagram tabulating VSWR characteristics of another modification of the embodiment;

FIG. 64 is a diagram tabulating VSWR characteristics of another modification of the embodiment;

DETAILED DESCRIPTION OF THE INVENTION

Figure 1:
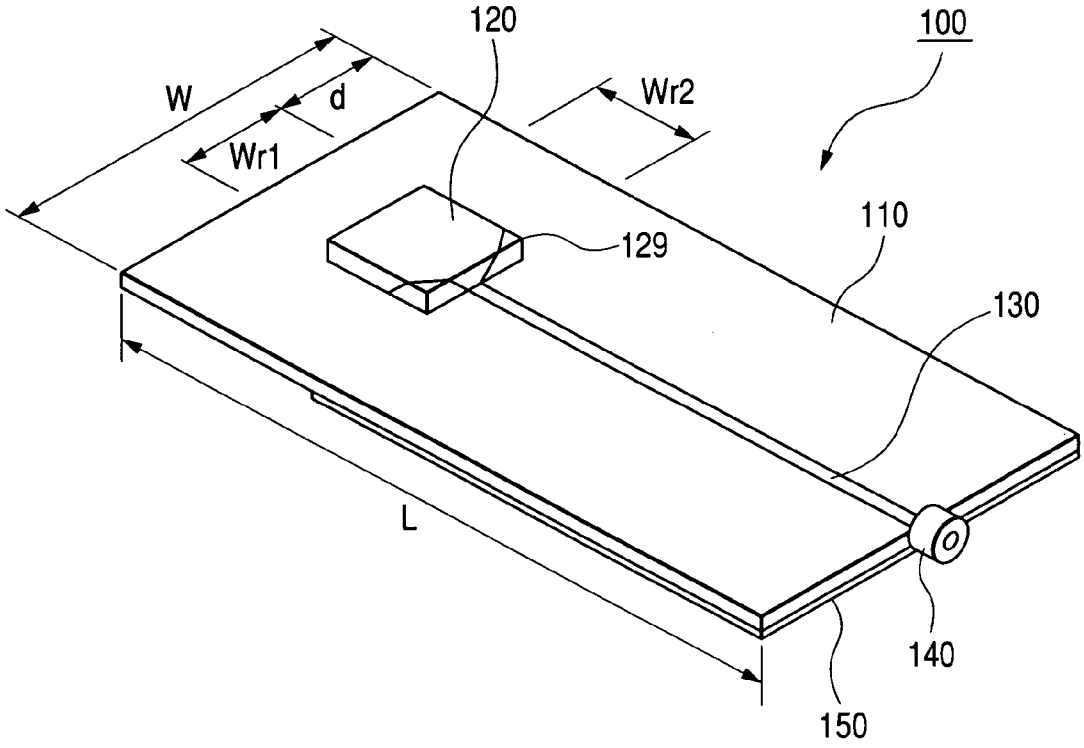
FIG. 1 is a perspective view showing an antenna device 100 according to a first embodiment of the invention in the direction from a radiation portion 120.

The antenna device according to the invention for solving at least a portion of the above-specified problems has its gist residing in that a conductor is formed on the surface of a column-shaped dielectric member to form an antenna electrode, and in that the antenna electrode is formed entirely in a stereoscopic shape from a feeder portion formed at one end of the antenna electrode toward the other end of the antenna electrode.

In this antenna device, the antenna electrode is formed on the surface of the dielectric member and has the stereoscopic shape. Therefore, the antenna device has a small size but functions as a wideband antenna. In this antenna device, the wavelength $\lambda$ of electromagnetic waves can be handled as $\lambda/\sqrt{\in}$ in the dielectric member having a dielectric constant $\in$. Therefore, the antenna device of the invention can be reduced in the entire size, as compared with an antenna device using no dielectric material. The dielectric member of this antenna device may have a column shape or a polygon such as a quadrangle prism, a pentagon or hexagon, and may be a column shape having different sectional areas between the feeder side and the leading side (or between one end to form the feeder portion and the other end). The dielectric material can adopt a variety of materials such not only as alumina but also as calcium titanate ($CaTiO_3$), magnesium titanate ($MgTiO_3$) or barium titanate ($BaTiO_3$). A conductor of any material can be adopted for the antenna electrode. Copper, aluminum, iron or tin may be selectively used for factors such as a purpose or price.

Here, the antenna electrode may preferably be formed into a conical shape. The band characteristics are improved by diverging the antenna electrode toward the leading end, that is, from a feeder portion formed at one end of the antenna electrode toward the other end of the antenna electrode. For this conical shape, the antenna electrode is formed on the individual surfaces of the dielectric member of a column shape such as a quadrangle shape. Moreover, a frustoconical shape may also be formed by diverging the antenna electrode formed on at least one face, from one end having the feeder portion arranged toward the other end. The stereoscopic shape can be entirely made, if the antenna electrodes are formed on at least three continuous faces. This entirely conical shape can be formed by the shape of the electrode on one face. This conical shape can also be made by forming the dielectric member itself in a triangular or quadrangle cone and by forming the antenna electrode on the surface of the cone.

Moreover, the antenna electrode may also be formed by forming electrodes not only on the three faces, i.e., the top face of the quadrangle prism and the side faces adjoining that top face but also such an electrode either on at least a portion of the face opposed to that top face or on at least a portion of the face opposed to the face on the feeder side as continues to the antenna electrode formed on the side faces or the top face. The antenna electrode is thus formed either on the top face and at least a portion of the opposed face or on a portion of the face on the feeder side and the opposed face, so that the antenna electrode can intensify its stereoscopy entirely to cover the wide band.

The invention of the method for manufacturing the antenna device thus far described has its gist residing: in that a dielectric member is formed into a predetermined shape; in that a feeding electrode to act as an antenna feeding portion is formed at a predetermined portion (e.g. at one end of the antenna electrode) of the dielectric member; and in that a conductor is formed on the surface of the dielectric member so that the conductor may be entirely formed into a stereoscopic shape from the position of the feeding electrode backward from the dielectric member (e.g., toward the other end of the antenna electrode). According to this manufacturing method, the miniature antenna device covering the wide band can be simply manufactured by that simple process.

Embodiments of the invention will be described in detail with reference to the accompanying drawings.

Figure 2:
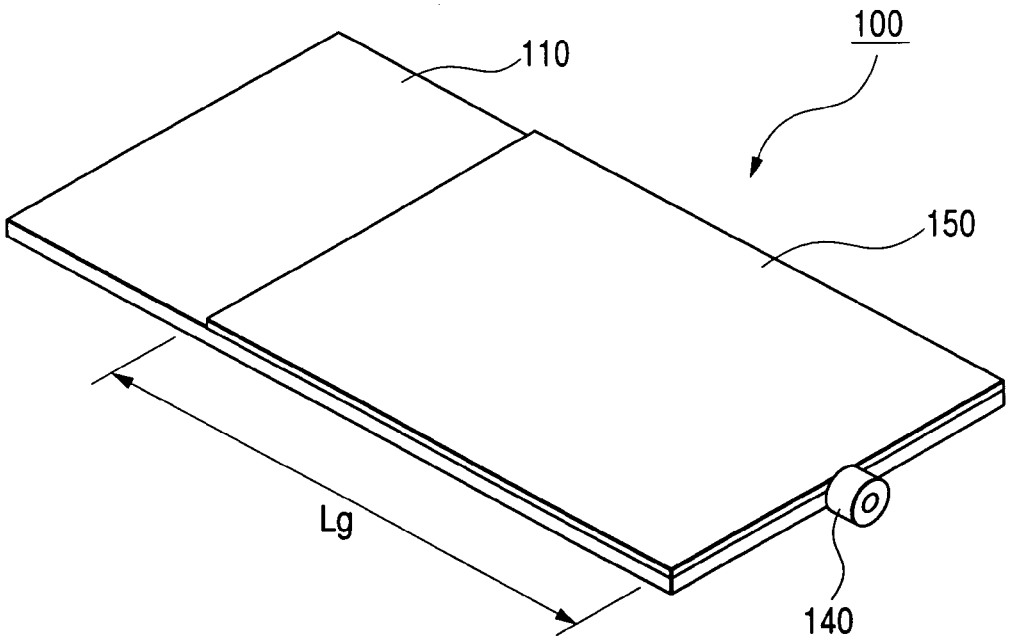
FIG. 2 is a perspective view showing the antenna device 100 according to the embodiment in the direction backward from the radiation portion 120.

FIG. 1 is a perspective view showing a construction of an antenna device 100 of a first embodiment according to the invention and taken in the direction from an antenna electrode (or a radiation portion), and FIG. 2 is a perspective view taken in the opposite direction.

As shown in FIG. 1 and FIG. 2, the antenna device 100 is constructed to include: a radiation portion 120 arranged on one principal face of a substrate 110; a feeder line 130 for inputting and outputting send-receive signals from and to the radiation portion 120; a feeder connector 140 for connecting the not-shown feeder wire with the feeder line 130; and a grounding conductor 150 formed on the other principal face of the substrate 110. The radiation portion 120 is arranged at a position, which is closer to one shorter side from near the center of one principal face of the substrate 110. The feeder line 130 is so shaped that its one end is electrically connected with a portion (or the feeder portion) of an antenna electrode formed in the radiation portion 120 and that it is extended in a band shape toward the other shorter side of the substrate 110. Moreover, the other end of the feeder line 130 is connected with the feeder connector 140. The grounding conductor 150 is formed in a rectangular plane shape on such a region of the other principal face as corresponds across the substrate 110 to the region having the feeder line 130 formed thereon. Specifically, the grounding conductor 150 is formed in the region, which is enclosed by the two opposite sides of the substrate 110, the straight line intersecting the two opposite sides and the one side of the substrate 110 confined by the two opposite sides. Here, the radiation portion 120 may also be formed to correspond to the region, which avoids the region having the grounding conductor 150 formed.

The substrate 110 is exemplified by a rectangular printed-circuit board and made of glass epoxy or the like. The substrate 110 may also function as a printed-circuit board for arranging another circuit other than the antenna device 100. Specifically, a substrate having parts such as a wireless circuit arranged therein maybe the substrate 110, or an independent substrate for the antenna device 100 may be the substrate 110. The radiation portion 120 is made of a dielectric material (or a base portion 129) cut out in a rectangular plate shape or a block shape, and has a thin film of a conductive material formed as an antenna electrode on its surface. The conductive material as the antenna electrode may be a thin conductor film such as a thin copper film or a thin silver film, and the dielectric material may be exemplified by ceramics formed in a plate shape. The radiation portion 120 functions as a radiator for radiating electric waves, and is associated with the grounding conductor 150 to construct the antenna device 100 acting in a quarter wavelength mode.

The feeder line 130 is made of a thin conductor film such as a thin copper film or a thin silver film, and acts to feed the send signal to the antenna electrode formed in the radiation portion 120 and to extract the receive signal. The feeder connector 140 is a high-frequency connector such as the SMA connector. The feeder line 130 is electrically connected with the signal line side (or the core line side) of the feeder connector 140, and the grounding conductor 150 is electrically connected with the ground side of the same. The feeder connector 140 may also be omitted, depending on the embodiment of the antenna device 100. The grounding conductor 150 is made of a thin conductor film such as a thin copper film or a thin silver film, and is formed in a rectangular planar shape on the other principal face (i.e., the principal face across the substrate 110 on the opposite side of the principal face, on which the radiation portion 120 is arranged) of the substrate 110. The grounding conductor 150 is formed to cover the whole face of such a region of the other principal face of the substrate 110 that the feeder line 130 is formed, namely, the region from the portion connected with the radiation portion 120 to the portion connected with the feeder connector 140. The grounding conductor 150 constructs a micro strip line together with the feeder line 130. Moreover, the grounding conductor 150 is formed not to overlap the radiation portion 120 across the substrate 110. In other words, the radiation portion 120 is arranged in the region, which avoids such a region across the substrate 110 as has the grounding conductor 150 formed. Moreover, the feeder portion of the radiation portion 120 is disposed at such one end of the radiation portion 120 as is the closest to the grounding conductor 150, and is electrically connected with the feeder line 130. The grounding conductor 150 has both the functions as a ground of the micro strip line or the feeder line and as the ground corresponding to the radiation portion 120.

Here, the antenna device 100 may be constructed such that it is mounted on one end of a circuit substrate having other circuit parts mounted thereon. Specifically, the antenna device 100 may be constructed such that it is not provided with the feeder connector 140 but introduces the send-receive signals from the wireless circuit mounted on the substrate 110, directly to the feeder line 130. In this case, the substrate 110 mounts the other circuit parts thereon and is housed in the not-shown case, for example, to construct a wireless LAN card to be fitted in the card slot of a computer. This wireless LAN card transfers data with the not-shown access point in accordance with the standards of the UWB. In case the antenna device 100 is thus mounted at one end of the circuit substrate, the substrate 110 is a multi-layered substrate, of which the inner layer has power and ground lines formed in a sold pattern. On the surface of the substrate 110, moreover, there is formed the feeder line 130, which feeds the electric power to the radiation portion 120.

Figure 3:
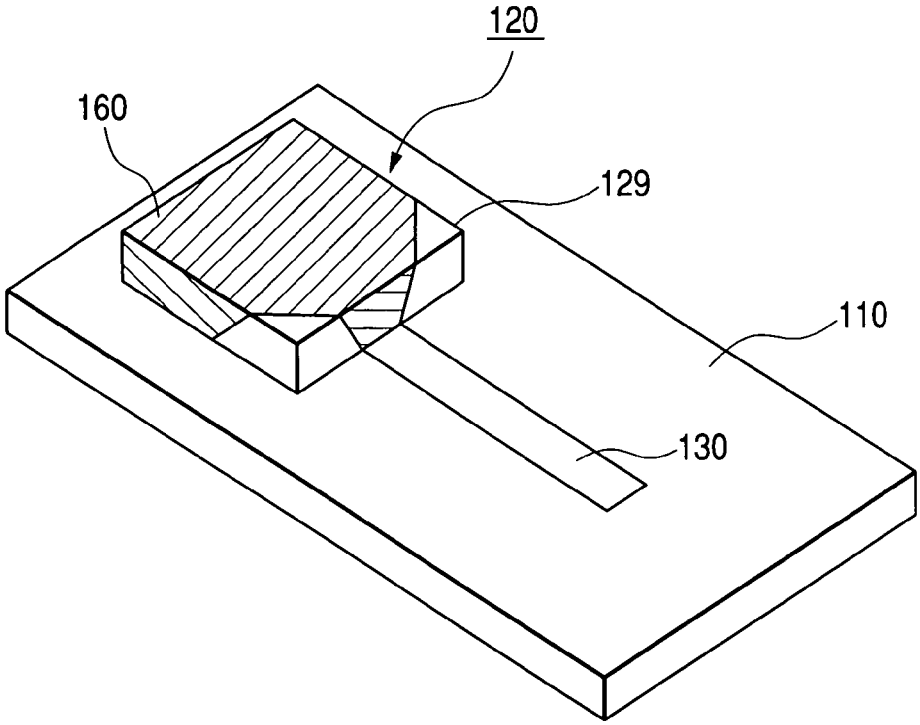
FIG. 3 is an enlarged view showing the shape of the radiation portion 120 in the antenna device 100 according to the embodiment.
Figure 4:
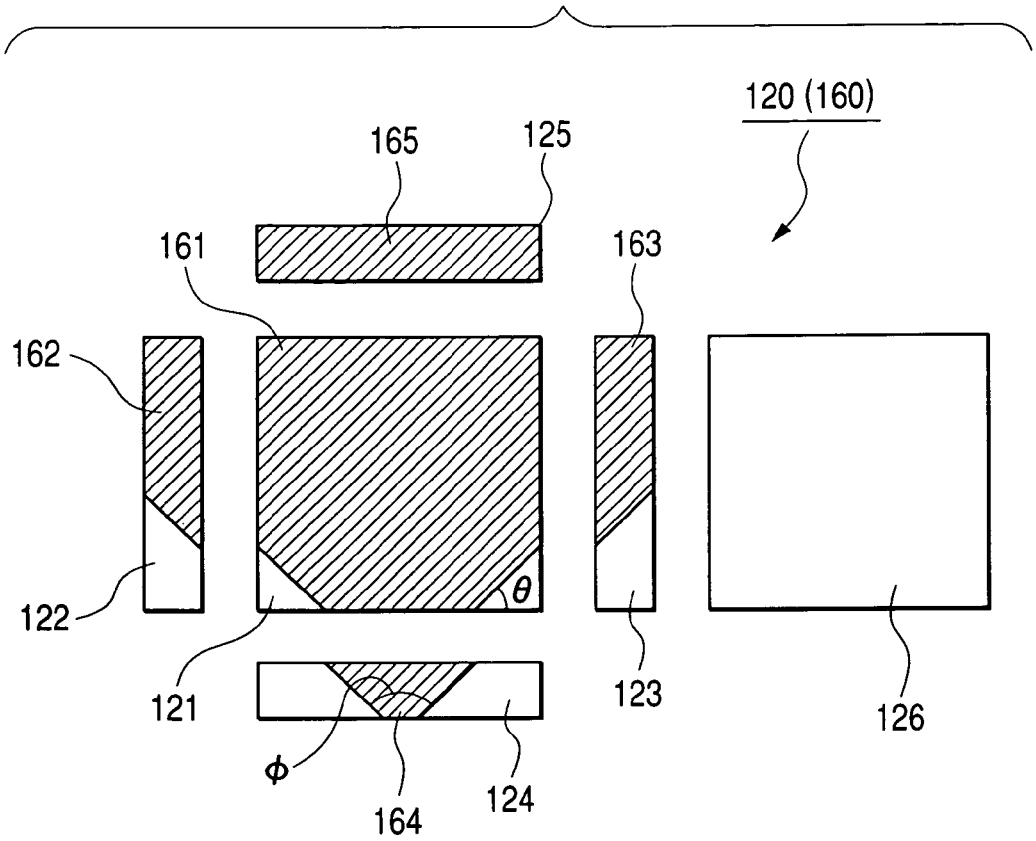
FIG. 4 is a development of the radiation portion 120 in the antenna device 100 according to the embodiment.
Figure 5:
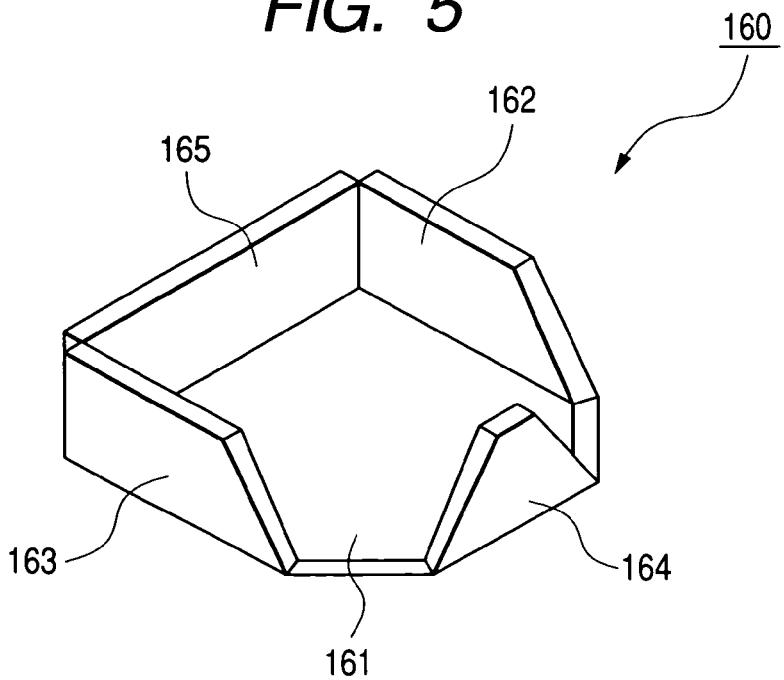
FIG. 5 is a view showing the radiation portion 120 in the antenna device 100 according to the embodiment in the direction from the joint face to a substrate 110.

Subsequently, the radiation portion 120 in the antenna device 100 will be described in detail with reference to FIG. 3 to FIG. 5. FIG. 3 is a perspective view showing the radiation portion 120 in an enlarged scale; FIG. 4 is a development of the radiation portion 120; and FIG. 5 shows the radiation portion 120 in the direction of the joint face to the substrate 110. Here, the illustration of the grounding conductor 150 is omitted in FIG. 3, and the illustration of the dielectric portion (or the base portion) constructing the radiation portion 120.

As shown in FIG. 3, the radiation portion 120 in the antenna device 100 is constructed to include the base portion 129 made of a rectangular plate of alumina, and an antenna electrode 160 formed on the five surfaces of the base portion 129. Specifically, the antenna electrode 160 is formed on all the faces of the surfaces of the base portion 129 excepting the joint face to the substrate 110. Here, the antenna electrode 160 may also be formed on at least three continuous faces excepting the face to contact with the substrate 110. In the embodiment, the base portion 129 is formed into a plate shape having sizes of 15 mm×15 mm×3 mm (in thickness). The base portion 129 may also be made of another dielectric material. The dielectric constant $\in$ and the sizes of the base portion 129 are designed according to the frequency band used.

As shown in FIG. 4, the antenna electrode 160 to be mounted in the radiation portion 120 of the embodiment is formed as electrodes 161 to 165, respectively, on the faces of the base portion 129, that is, one top face 121, two side faces 122 and 123, a front face 124 to be connected with the feeder line 130, and a back face 125 opposed to the front face 124. In the following description, of the surfaces of the base portion 129, the "front face" means the face, on which the feeder line 130 is connected with the base portion 129, and the "bottom face" means the face, on which the base portion 129 is arranged to contact with the substrate 110. No electrode is formed on a bottom face 126 corresponding to the top face 121. The antenna electrode 160 is made of silver, for example, in the embodiment. The antenna electrode 160 has a thickness of 10 to 15 μm and is prepared by screen printing silver paste on the surface of the base portion 129 and then by sintering it at 850° C. The antenna electrode may also be prepared by forming it on the surface of the base portion 129 by another method such as the depositing, sputtering or plating method. The antenna electrodes 161, 162, 163, 164 and 165 formed on the top face 121, the two side faces 122 and 123, the front face 124 and the back face 125 are all made electrically conductive to one another. Of the electrodes 161 to 165, the electrode 164 connected with the feeder line 130 has a function as the feeder portion of the antenna device 100.

As shown in FIGS. 4 and 5, the antenna electrode 160 is formed into a (radial) shape to have its area (or region) gradually enlarged from the electrode 164 formed on the front face 124 soldered to one end of the feeder line 130 to receive the fed electric power toward the back face 125, and is given in a stereoscopic shape by the electrode 16*q* on the top face 121, the electrodes 162 and 163 on the two side faces 122 and 123, and the electrodes 164 and 165 on the front face 124 and the back face 125. In the recess formed by the electrodes 161 to 165 shown in FIG. 5, moreover, there exists the base portion 129, which is made of the dielectric material having the dielectric constant $\in$.

Thus, according to the invention of this embodiment, in the radiation portion 120, the antenna electrode 160 encloses the base portion 129 made of the dielectric material. It is, therefore, possible to make the size of the entire antenna smaller than that of the ordinary antenna of a quarter wavelength mode. According to the invention of the embodiment, moreover, the antenna electrode 160 is formed to have its region gradually enlarged radially from its feeder portion (or the electrode 164) toward the opposed electrode 165 (or in the direction away from the grounding conductor 150). It is, therefore, possible to enlarge the frequency band width suited for the use.

Figure 6:
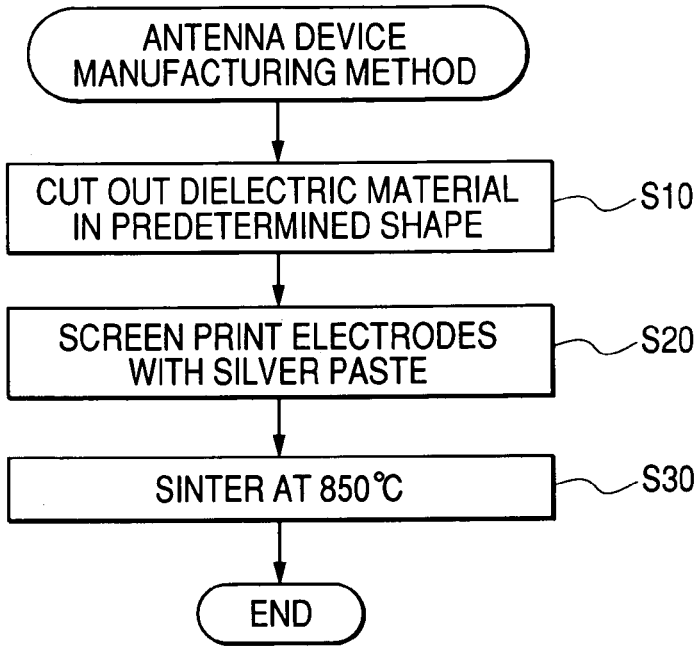
FIG. 6 is a flowchart showing a manufacturing process of the radiation portion 120 of a manufacturing method of the antenna device 100 in the embodiment.

Next, a method for manufacturing the antenna device 100 according to the invention will be described with reference to FIG. 6. FIG. 6 is a flow chart showing a manufacturing process of the radiation portion 120 in the manufacturing method of the antenna device 100.

As shown in FIG. 6, a dielectric material (e.g., alumina) having the dielectric constant ∈ is cut out in a predetermined shape (e.g., a quadrangle shape of 15 mm×15 mm×3 mm in the embodiment) into the base portion 129 (at Step S10).

Next, silver paste is applied by the screen printing method onto the individual faces of that base portion 129 (at Step 20). In the embodiment shown in FIG. 1 to FIG. 4, the silver paste is applied in the shapes of the electrodes 161 to 165, as shown in FIG. 4, respectively the top face 121, the side face 122, the side face 123, the front face 124 and the back face 125 excepting the face to contact with the substrate 110.

Then, the base portion 129 having the silver paste applied thereto is put into a sintering furnace and is sintered at 850° C. (at Step 30). By this sintering treatment, the silver paste is formed as the thin silver film on the desired surfaces of the base portion 129 so that the radiation portion 120 is completed.

Subsequently, a substrate (e.g., an glass epoxy substrate) to arrange the radiation portion 120 is cut out in a predetermined size into the substrate 110. A thin copper film is formed as the grounding conductor 150 on one side of the substrate 110. At this time, the grounding conductor 150 is formed not on the region corresponding to the arrangement position of the radiation portion 120 but only on the portion excepting that region. As a result, the grounding conductor 150 functions as the radiation element of the antenna without obstructing the electromagnetic wave radiating action of the radiation portion 120.

On the substrate 110, on the other hand, the necessary feeder line 130 is formed of a thin copper film and is electrically connected with a predetermined wireless circuit. Then, the completed radiation portion 120 is arranged at a predetermined position on the substrate having the grounding conductor 150 formed thereon. The radiation portion 120 is fixed on the substrate 110 by means of an adhesive.

The antenna device 100 can be simply manufactured by the process thus far described.

Figure 7:
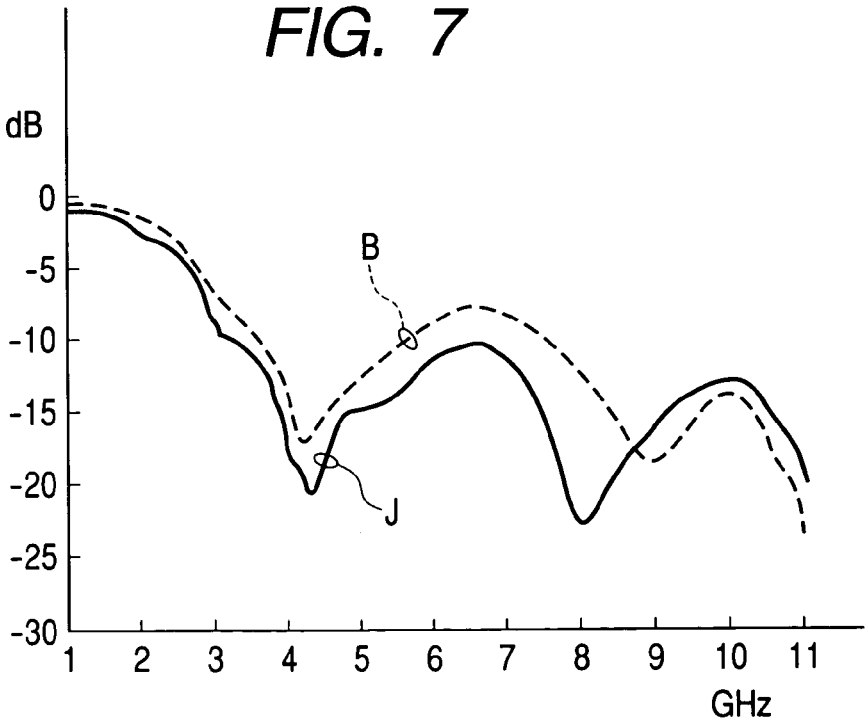
FIG. 7 is a diagram illustrating frequency characteristics in an example according to the embodiment.
Figure 8:
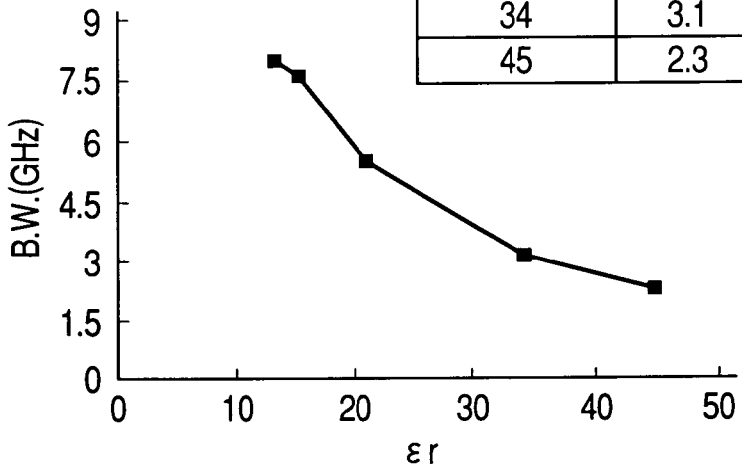
FIG. 8 is a diagram illustrating a relation between the embodiment constant of a base portion 129 and a usable frequency band width in the example according to the embodiment.
Figure 9:
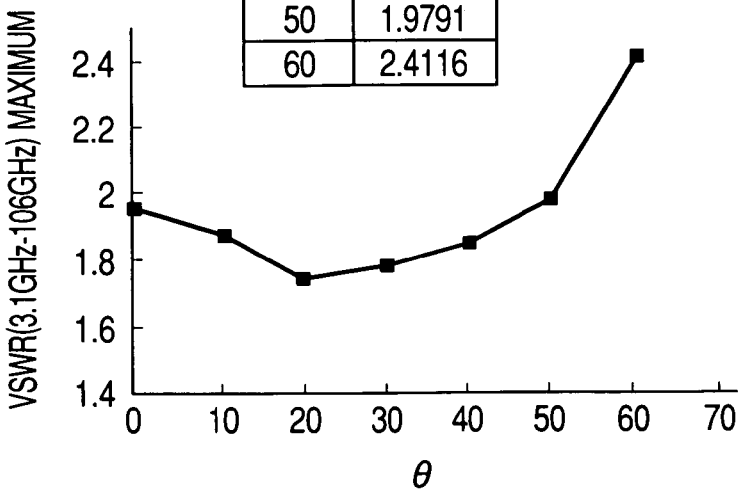
FIG. 9 is a diagram illustrating a relation between the shape of an antenna electrode 160 and antenna characteristics in the example of the embodiment.

Here, an example of the antenna device 100 according to the embodiment will be described in detail with reference to FIG. 7 to FIG. 9. FIG. 7 is a diagram illustrating the frequency characteristics of the example according to the embodiment; FIG. 8 is diagram plotting a relation between the dielectric constant of the base portion 129 and the usable frequency band width of the same; and FIG. 9 is a diagram plotting a relation between the shape of the antenna electrode 160 formed on the base portion 129 and the antenna characteristics. The following description will be made by using the reference characters shown in FIG. 1 and FIG. 2.

First of all, by the process shown in FIG. 6, a ceramic plate was cut out as the base portion 129 in a quadrangle shape having a width Wr1 of 15 mm, a length Wr2 of 15 mm and a thickness of 3 mm, and the thin silver film of the pattern shown in FIG. 4 was formed on the five faces excepting the face to contact with the substrate 110, thereby to form the radiation portion 120. Next, a glass epoxy substrate (FR-4) having a thickness of 1 mm was cut out as the substrate 110 in a rectangular shape having a length L of 100 mm and a width W of 50 mm.

Then, a band-shaped thin copper film having a length (Lg) of 70 mm was formed by etching from the substantially central portion of one shorter side of one principal face of the cut-out substrate 110 toward the other shorter side, thereby to construct the micro strip line. Moreover, the thin copper film having a length of 30 mm and a width of 50 mm was etched off from the other shorter side of the other principal face of the cut-out substrate 110 toward the one shorter side. As a result, the region having the length Lg of 70 mm corresponding to the micro strip line and the width W of 50 mm was formed as the grounding conductor 150.

Subsequently, the radiation portion 120 having the thin silver film was adhered to that face of the substrate 110, which was opposed to the face to form the grounding conductor 150. The radiation portion 120 was so arranged as could be connected with the open end of the micro strip line formed on the substrate 110, and was soldered to the electrode 164 formed on the front face 123 of the radiation portion 120.

Thus, the antenna device 100 shown in FIG. 1 and FIG. 2 was completed. The radiation portion 120 had sizes of 15 mm×15 mm×3 mm, and the substrate 110 had sizes of 100 mm×50 mm. The grounding conductor 150 contacted with the three continuous sides of the substrate 110, and had the sizes of a length of 70 mm and a width of 50 mm. Moreover, the radiation portion 120 was so arranged that its front face 124 was located at substantially the same position in the longer side direction of the substrate 110 as that of the shorter side of the grounding conductor 150.

FIG. 7 is a diagram illustrating the reflection characteristics of the antenna device 100 thus completed. As indicated by a solid curve J in FIG. 7, the antenna device 100 of this example has reflection characteristics of −10 dB over a wide band from 3 GHz to 11 GHz, and has excellent antenna characteristics. Here, a broken curve B in FIG. 7 indicates the characteristics of the case of an antenna having the same shape, in which the antenna electrode 161 is formed only on the top face 121 of the base portion 129 of the dielectric member. Comparison of the two curves indicates that the solid curve J has the reflection characteristics improved over substantially all frequency bands. It is, therefore, found that the characteristics as the antenna are improved over the wide range by forming the antenna electrode 160 into such a stereoscopic shape as to enclose (or extend along) the base portion 129 made of the dielectric material, as in the example.

On the other hand, FIG. 8 shows a relation between the specific dielectric constant ∈r of the base portion 129 of the dielectric member and the used frequency band width, that is, the variation of the frequency band width the most suitable for use in the antenna device 100 of the case, in which the specific dielectric constant ∈r of the base portion 129 is varied. The measurement of the frequency band width the most suitable for the use was made under the condition of VSWR<2.

As shown in FIG. 8, a correlation is shown between the specific dielectric constant ∈r of the base portion 129 constructing the radiation portion 120 and the frequency band width of the antenna device 100. Specifically, there is found a tendency for the usable frequency band width to become the narrower as the dielectric constant becomes the larger. A frequency band width of about 7.5 GHz is needed for use in the communication of the UWB. In this case, therefore, the specific dielectric constant ∈r may be 15 or less. For a wider band, moreover, the specific dielectric constant ∈r may be 13 or less. For a smaller band width to be used, it is possible to use a material of a higher dielectric constant. Moreover, the bandwidth to be used is different for the sizes of the base portion 129. If the specific dielectric constant ∈r and the sizes of the antenna electrode 160 are properly designed for the using object, it is possible to provide an antenna device 100 of smaller sizes and wider bands.

Further investigations were also made on the extending state and the antenna characteristics of the antenna electrode 160. Specifically, the angle of inclination of the electrode 161 over the top face 121 in FIG. 4 with respect to the side to contact with the front face 124 is designated by θ. The measurements of this angle θ and the maximum of the VSWR within the frequency band of 3.1 GHz to 10.6 GHz are plotted in FIG. 9. Here, the base portion 129 was made of a dielectric material having a specific dielectric constant ∈r of 13.

The maximum value of the VSWR is varied by varying the angle θ, as shown in FIG. 9. For a general use, it is desired that the VSWR has a value of 2 or less. It is, therefore, desired that the angle θ is about $0 \leqq \theta \leqq 50$ degrees. Naturally, the use outside of this range raises no problem in accordance with the specifications. Specifically, the angle θ may be made within a range of $10 \leqq \theta \leqq 40$ degrees by setting the VSWR at 1.9 or less, or within a range of $20 \leqq \theta \leqq 30$ degrees by setting the VSWR at 1.8 or less.

In other words, the antenna electrode 160 so desired for the case of the VSWR having a value of 2 or less as is formed into a radial shape having a center angle ϕ of 80 degrees or more (180−50×2) and 180 degrees or less (180−0×2), as shown in FIG. 4, with respect to the straight curve from the electrode 164 or the feeder point at one end of the antenna electrode 160 toward the electrode 165 or the other end of the antenna electrode 160 (or apart from the grounding conductor 150). Likewise, the antenna electrode 160 may also be formed into a radial shape having a center angle ϕ of 100 degrees or more and 160 degrees or less for the VSWR value of 1.9 or less and 120 degrees or more and 140 degrees or less for the VSWR value of 1.8 or less.

Figure 10:
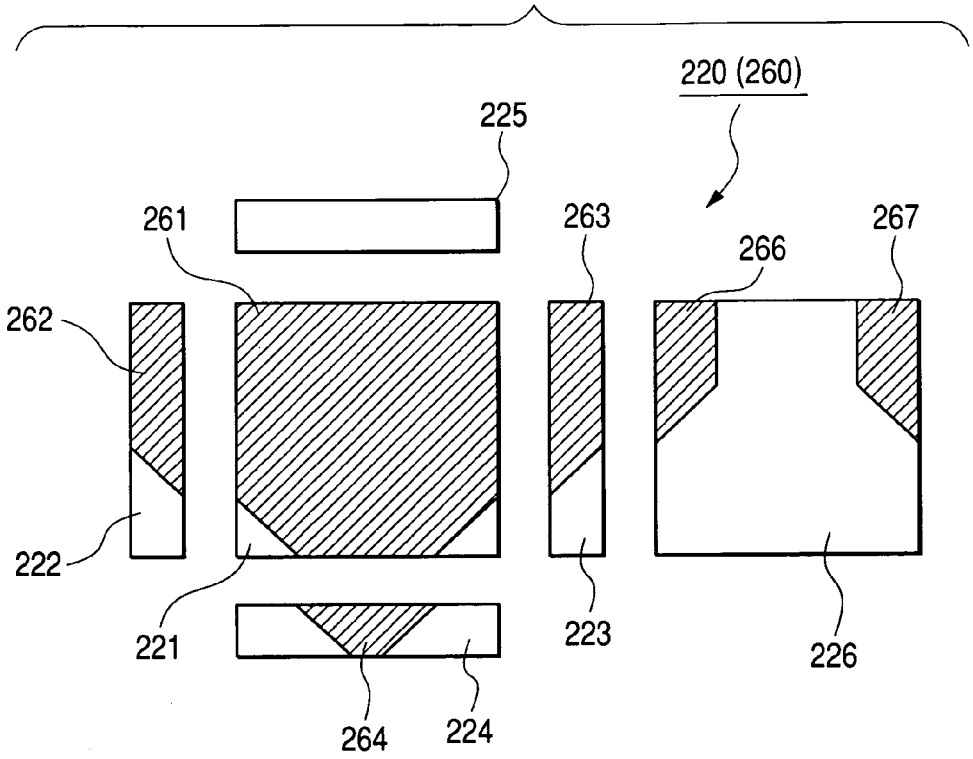
FIG. 10 is a development showing a radiation portion 220 according to a second embodiment of the invention.

Next, a second embodiment of the antenna device 100 according to the invention will be described with reference to FIG. 10. FIG. 10 is a development showing a radiation portion 220 of the antenna device 100 according to the embodiment. The antenna device according to this embodiment is constructed to include the substrate 110, the feeder line 130, the feeder connector 140, the grounding conductor 150, as shown in FIG. 1 and FIG. 2, and the radiation portion 220, as shown in FIG. 10. The difference from the antenna device 100 according to the first embodiment is only the construction of the radiation portion 120. Therefore, the following description is omitted on the portion, which overlaps the antenna device 100 according to the first embodiment.

In the radiation portion 220 in the antenna device of this embodiment, as shown in FIG. 10, electrodes 261 to 264, and 266 and 267 are formed, respectively, on a top face 221, a side face 223, a side face 223 and a front face 224, and a bottom face 226 to contact with the substrate 110. The electrodes 261 to 264, as formed on the top face 221, the side face 222, the side face 223 and the front face 224, are formed in shapes and at positions like those of the electrodes 161 to 164 in the radiation portion 120.

The radiation portion 220 in the antenna device of this embodiment is different in the following points from the radiation portion 120 in the first embodiment.

[1] No electrode is formed on a back face 225.

[2] The electrodes 262 and 263 on the two side faces 222 and 223 are extended as they are to the bottom face 226 opposed to the top face 221, so that the two electrodes 266 and 267 are formed on the bottom face 226.

Therefore, the electrodes 261 to 264, and 266 and 267 are shaped, entirely of an antenna electrode 260, to enclose the base portion of the radiation portion 220 more than those of the first embodiment. Moreover, those two electrodes 266 and 267 are gradually widened toward the back face 225, and the antenna electrode is widened, entirely of the antenna electrode, in a triangular shape from the feeder side.

The radiation portion 220 having the antenna electrode 260 thus shaped also has exhibited excellent antenna characteristics over a wide band.

Figure 11:
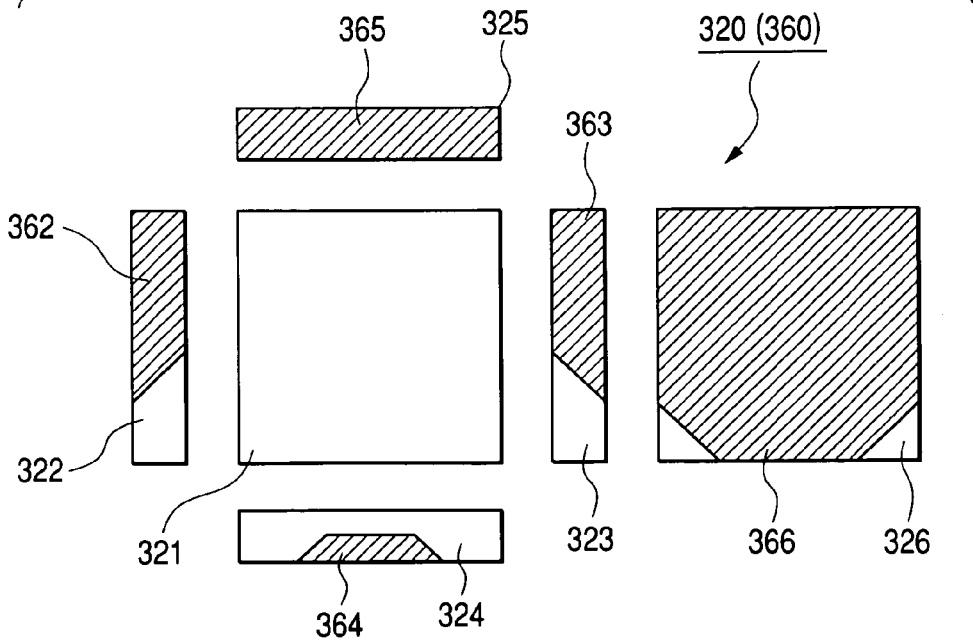
FIG. 11 is a development showing a radiation portion 320 according to a third embodiment of the invention.

Subsequently, a third embodiment of the antenna device according to the invention will be described with reference to FIG. 11. FIG. 11 is a development showing a radiation portion 320 of the antenna device according to the embodiment. The antenna device according to this embodiment is constructed to include the substrate 110, the feeder line 130, the feeder connector 140, the grounding conductor 150, as shown in FIG. 1 and FIG. 2, and the radiation portion 320, as shown in FIG. 11. The difference from the antenna device 100 according to the first embodiment is only the construction of the radiation portion 120. Therefore, the following description is omitted on the portion, which overlaps the antenna device 100 according to the first embodiment.

As shown in FIG. 11, the radiation portion 320 in this embodiment has electrodes 362 to 366 formed on a side face 322, a side face 323, a front face 324, and a bottom face 326 to contact with the substrate 110, respectively.

The radiation portion 320 in the antenna device of this embodiment is different in the following points from the radiation portion 120 in the first embodiment.

[1] The electrode 366 is formed on the bottom face 326 in place of a top face 321.

[2] The electrode 364 of the front face 324 is formed to sizes necessary for being soldered to the feeder line 130.

Therefore, the electrodes 362 to 366 are so shaped, entirely of an antenna electrode 360, as turned just upside-down from the antenna electrode 160 of the first embodiment. The antenna device thus provided with the radiation portion 320 having the upside-down arrangement of the antenna electrode 160 in the base portion 129 has also exhibited excellent antenna characteristics over a wide band.

Figure 12:
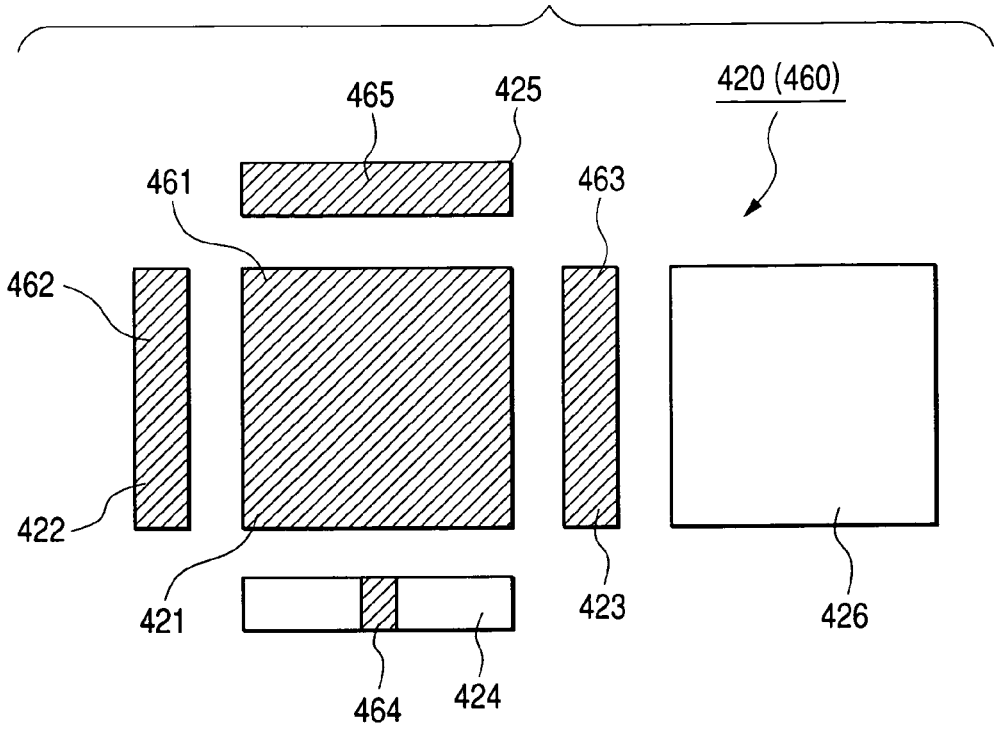
FIG. 12 is a development showing a radiation portion 420 according to a fourth embodiment of the invention.

Subsequently, a third embodiment of the antenna device according to the invention will be described with reference to FIG. 12. FIG. 12 is a development showing a radiation portion 420 of the antenna device according to the embodiment. The antenna device according to this embodiment is constructed to include the substrate 110, the feeder line 130, the feeder connector 140, the grounding conductor 150, as shown in FIG. 1 and FIG. 2, and the radiation portion 420, as shown in FIG. 12. The difference from the antenna device 100 according to the first embodiment is only the construction of the radiation portion 120. Therefore, the following description is omitted on the portion, which overlaps the antenna device 100 according to the first embodiment.

As shown in FIG. 12, the radiation portion 420 in this embodiment has electrodes 461 to 465 formed on a top face 421, a side face 422, a side face 423, a front face 424, and a back face 425.

The radiation portion 420 in the antenna device of this embodiment is different in the following points from the radiation portion 120 in the first embodiment.

[1] The electrodes 461 to 463 of the top face 421 and the side faces 422 and 423 are formed not in shapes to diverge toward the back face 425 but in shapes to cover the individual faces entirely.

[2] The electrode 464 of the front face 424 is connected to the electrode 461 of the top face 421 while keeping the same width as that of the feeder line 130.

Therefore, the electrodes 461 to 465 are formed, entirely of an antenna electrode 460, in a quadrangle-shaped cylindrical shape. The antenna device has exhibited excellent antenna characteristics over a wide band, even if it does not have a shape diverging from the feeder line.

Figure 13:
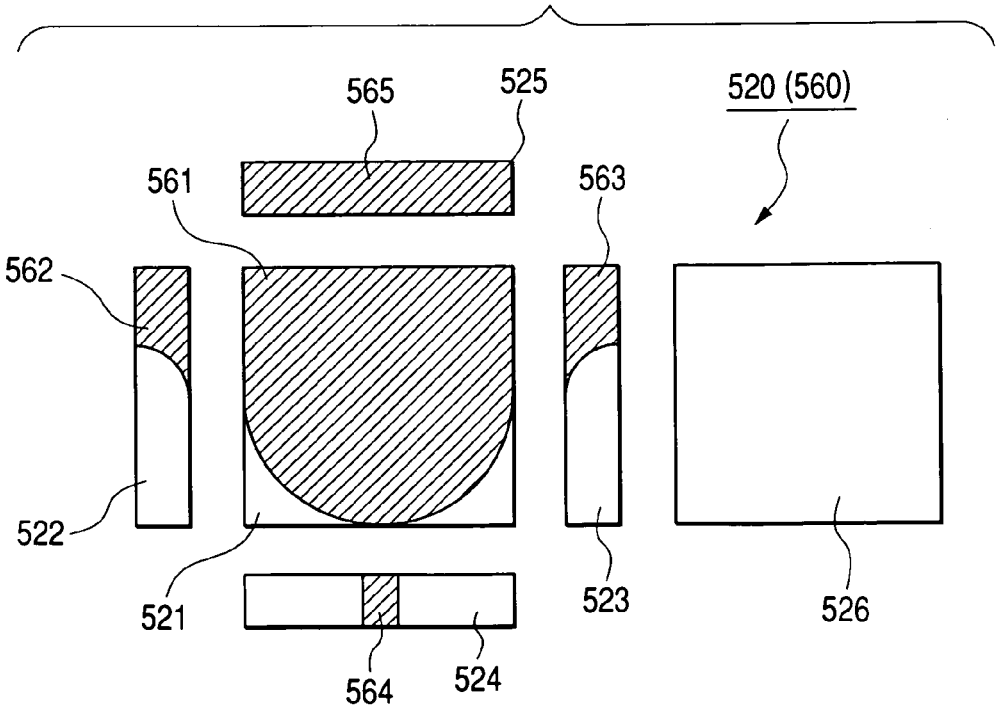
FIG. 13 is a development showing a radiation portion 520 according to a fifth embodiment of the invention.

Thus, the antenna electrode can be formed in the various shapes for the base portion made of the dielectric material. These shapes can be determined from the using object and the frequency characteristics. An arcuate shape can be adopted, for example, as shown in FIG. 13. FIG. 13 is a development showing a radiation portion 520 of an antenna device according to a fifth embodiment of the invention. As shown in FIG. 13, the radiation portion 520 in this embodiment is formed in the arcuate shape from the feeder line toward a back face 525.

Moreover, the antenna electrode to be formed in the base portion of the radiation portion may be entirely formed in a stereoscopic shape by determining a triangular, square, rectangular, trapezoidal, circular, elliptical, semicircular or sector shape or an arbitrary polygonal shape and by assigning this shape to the individual faces of the base portion. In short, the antenna electrode may also be so formed that the antenna electrode of such shape may enclose the base portion made of the dielectric material.

Figure 14:
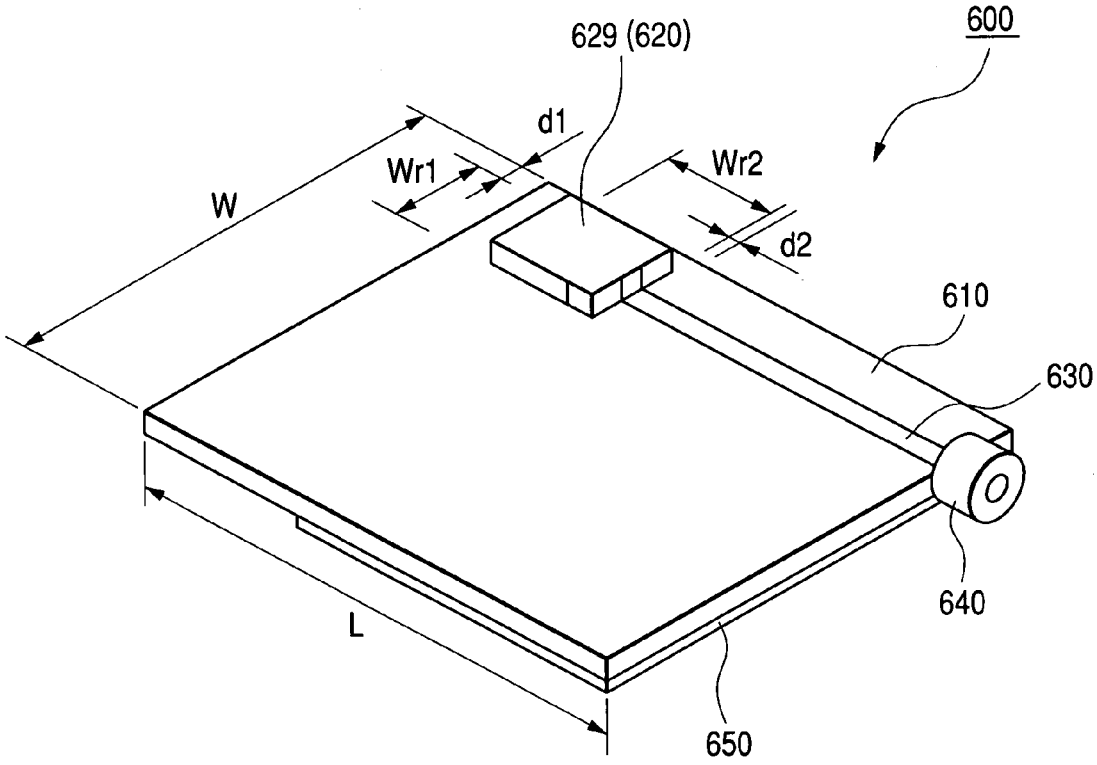
FIG. 14 is a perspective view showing an antenna device 600 according to a sixth embodiment of the invention in the direction from a radiation portion 620.
Figure 15:
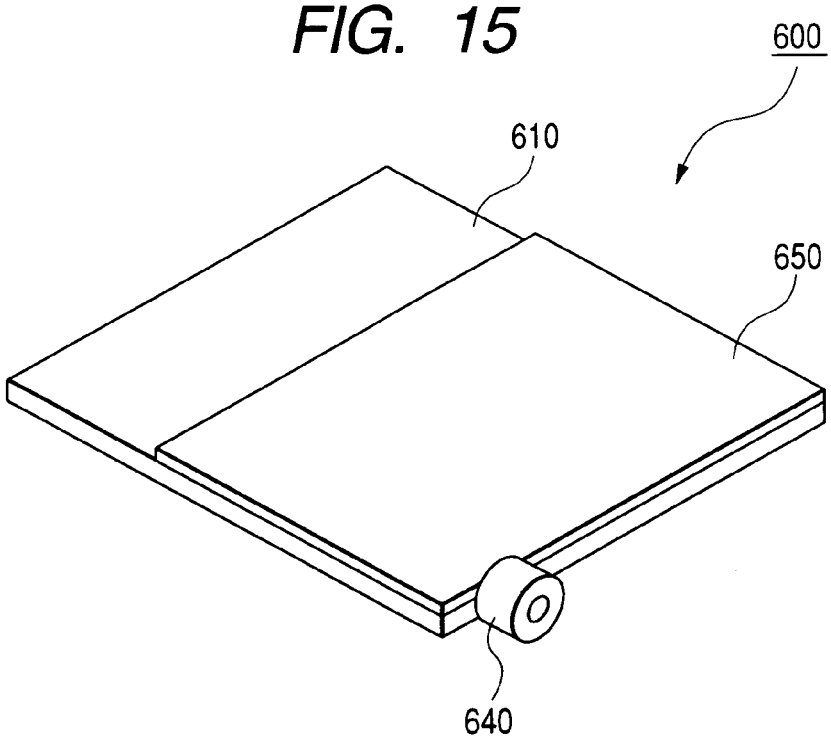
FIG. 15 is a perspective view showing the antenna device 600 according to this embodiment in the direction backward from the radiation portion 620.
Figure 16:
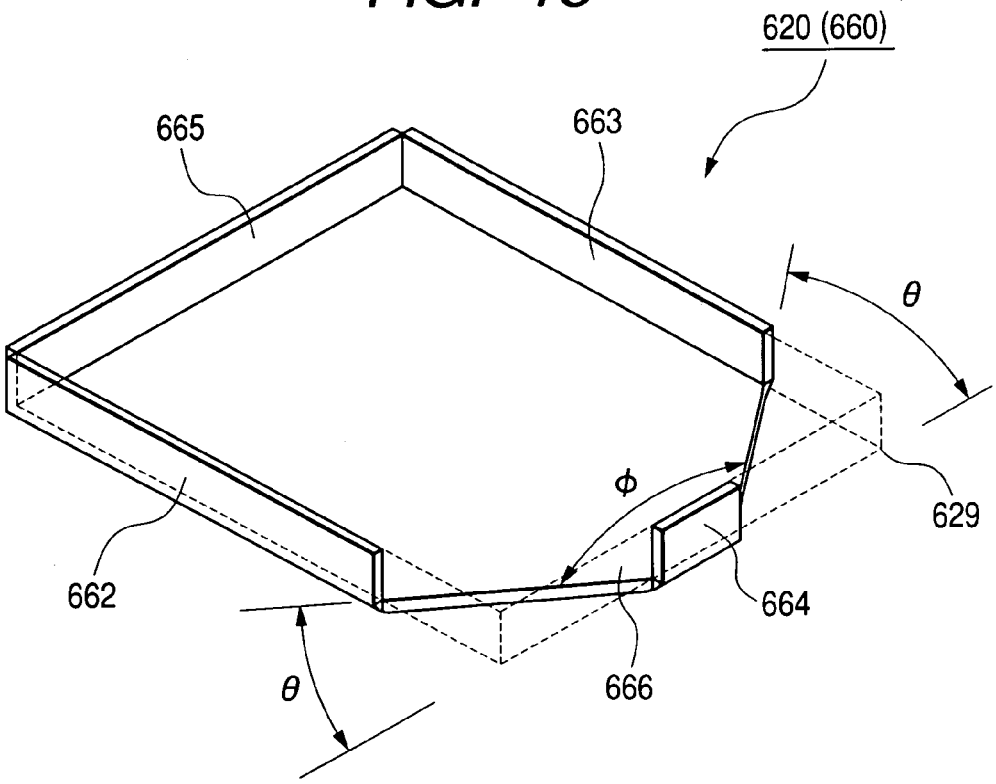
FIG. 16 is a perspective view showing a construction of the radiation portion 620 in the antenna device 600 according to this embodiment.

Next, a sixth embodiment of the antenna device according to the invention will be described in detail with reference to FIG. 14 to FIG. 16. FIG. 14 is a perspective view showing an antenna device 600 according to the sixth embodiment of the invention in a radiation conductor arranging direction; FIG. 15 is a perspective view showing the same in a grounding conductor direction; and FIG. 16 is a perspective view showing the construction of a radiation portion.

As shown in FIG. 14 and FIG. 15, the antenna device 600 according to this embodiment is constructed to include: a base portion 629 constructing a radiation portion 620 arranged on one principal face of a substrate 610; a feeder line 630 for inputting and outputting send-receive signals from and to the radiation portion 620; a feeder connector 640 for connecting the not-shown feeder wire with the feeder line 630; and a grounding conductor 650 formed on the other principal face of the substrate 610.

The base portion 629 constructing the radiation portion 620 is arranged at a position, which is located closer from near the center of one principal face of the rectangular substrate 610 to one long side, for example. Here, the base portion 629 constructing the radiation portion 620 may also be arranged at a position spaced in parallel with the principal face of the substrate 610 from the region forming the grounding conductor 650 and closer to the peripheral edge portion of the substrate 610. Alternatively, the base portion 629 may also be arranged closer to any side of the substrate 610 in the direction along the side portion of the grounding conductor 650 opposed across the substrate 610. The feeder line 630 is electrically connected at its one end with a portion of the antenna electrode formed in the base portion 629 constructing the radiation portion 620, and is extended in a band shape in the direction toward the forming region of the grounding conductor 650. Moreover, the other end of the feeder line 630 is connected with the feeder connector 640. This feeder connector 640 is fixed on the edge portion of the substrate 610. The grounding conductor 650 is formed in a planar shape on the region of the other principal face of the substrate 610 corresponding to the region having the feeder line 630 formed, and is electrically connected with the feeder connector 640.

The substrate 610, the radiation portion 620, the base portion 629, the feeder line 630, the feeder connector 640 and the grounding conductor 650 correspond to the substrate 110, the radiation portion 120, the base portion 129, the feeder line 130, the feeder connector 140 and the grounding conductor 150 in the first embodiment, respectively, and are made of similar materials and provided with similar features. In short, the antenna device 600 according to this embodiment are modified from the antenna device 100 according to the first embodiment shown in FIG. 1 to FIG. 4, by changing the shape of the radiation portion 120 and the arrangement position in the substrate 110 from the antenna device 100 according to the first embodiment, as shown in FIG. 1 to FIG. 4. In the following description, therefore, the following description is omitted on the portions common to those of the antenna device 100 according to the first embodiment.

In the antenna device 600 according to this embodiment, as shown in FIG. 14, the radiation portion 620 (or the base portion 629) is arranged close to but at a distance d1 from one longer side of the substrate 610. Moreover, the radiation portion 620 and the grounding conductor 650 are arranged across the substrate 610 at a predetermined distance d2 in the longer side direction of the substrate 610. The feeder line 630 is so arranged to extend in parallel with the longer sides of the substrate 610 as to correspond to the position of the radiation portion 620. The feeder connector 640 is arranged at a position to correspond to the feeder line 630.

FIG. 16 is a perspective view showing a stereoscopic shape of an antenna electrode 660, which constructs the radiation portion 620 of the antenna device 600 according to this embodiment. In FIG. 16, the base portion 629 is shown by broken lines so as to make the shape of the antenna electrode 660 easily understandable.

In the radiation portion 620 of this embodiment, as shown in FIG. 16, like the radiation portion 320 of the third embodiment of the invention shown in FIG. 11, electrodes 662 to 666 are formed on the five faces excepting the top face of the base portion 629 made of a dielectric material, thereby to form the antenna electrode 660 altogether. Specifically, the electrodes 662 to 666 are formed individually on the two side faces, the front face, the back face and such a bottom face of the base portion 629 as to contact with the substrate 610. The electrode 664 is formed to have sizes necessary and sufficient for being soldered to the feeder line 630. On the other hand, the electrode 666 formed on the bottom face of the base portion 629 is so linearly formed at an angle of inclination θ from the side to contact with a front face 624 that its region may be gradually widened from the side to contact with the electrode 664 toward the electrodes 662 and 663 formed on the two side faces of the base portion 629. In other words, the electrode 66 is linearly formed at the center angle ϕ with respect to the straight line directed from the electrode 664 (i.e., one end of the electrode 660) to the electrode 665 (i.e., the other end of the electrode 660), thereby to form a linearly symmetric trapezoidal shape.

Figure 17:
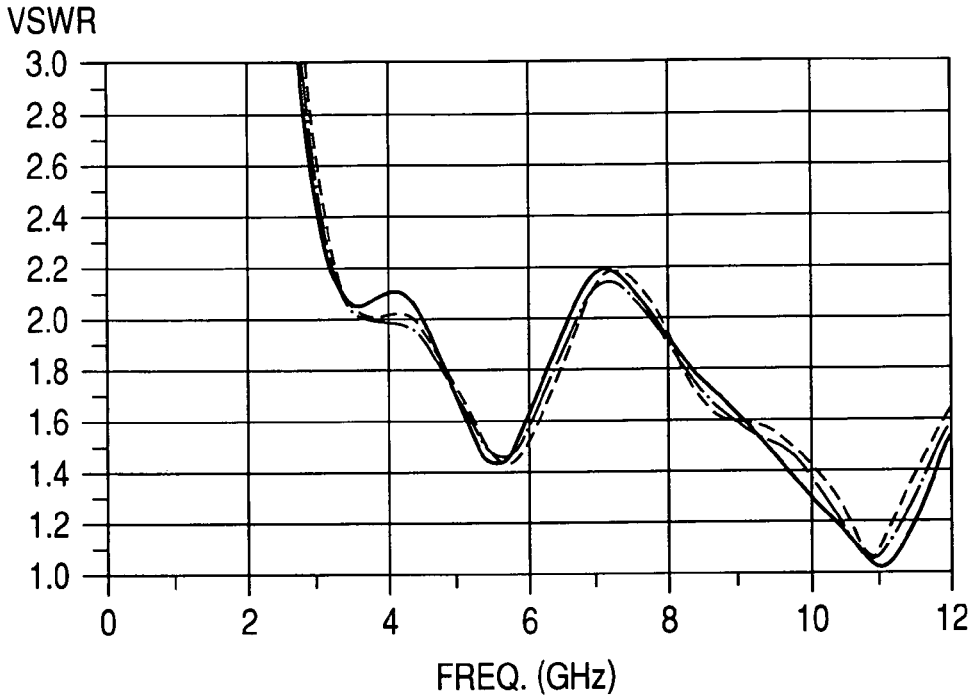
FIG. 17 is a diagram illustrating VSWR characteristics in this embodiment.
Figure 18:
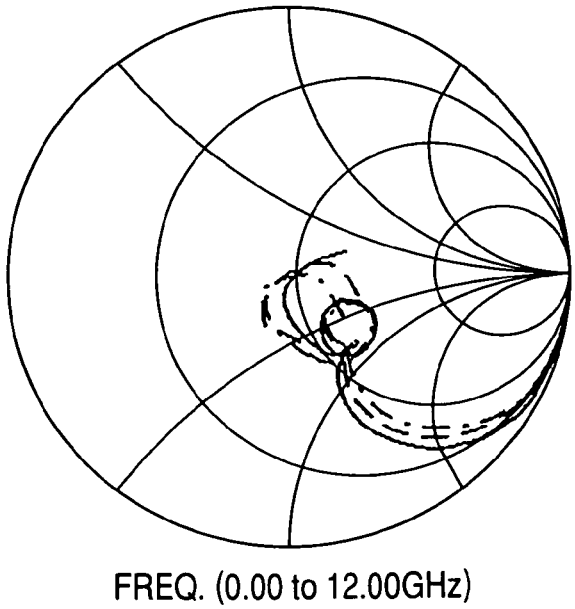
FIG. 18 is a Smith chart in this embodiment.
Figures 19, 20:
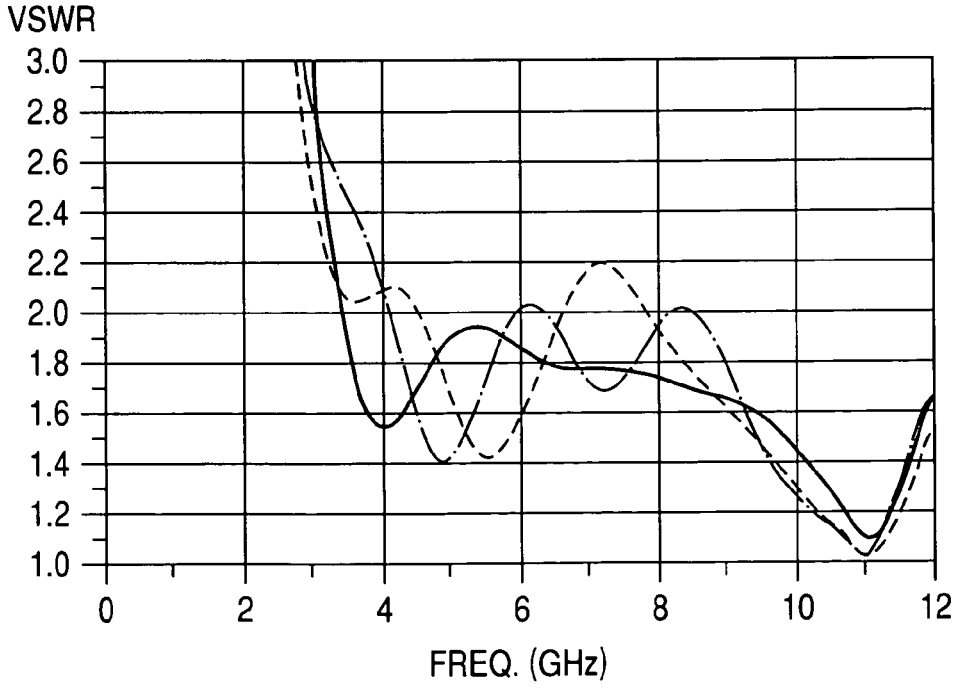
FIG. 19 is a diagram tabulating frequency bands suited for use in this embodiment.
FIG. 20 is a diagram illustrating VSWR characteristics in this embodiment.
Figure 23:
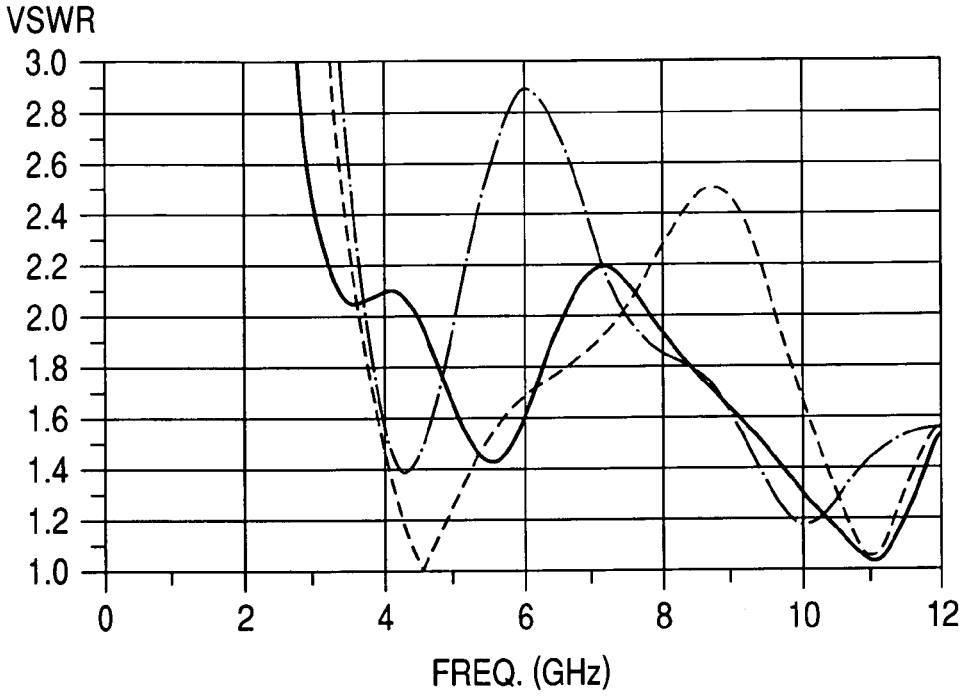
FIG. 23 is a diagram illustrating VSWR characteristics in this embodiment.
Figure 24:
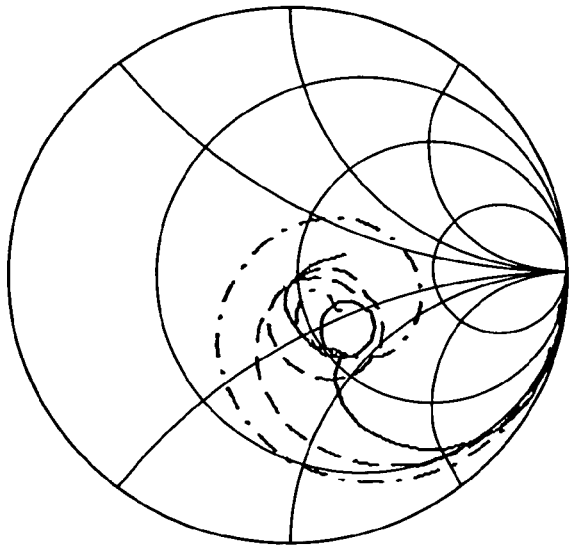
FIG. 24 is a Smith chart in this embodiment.
Figures 25, 26:
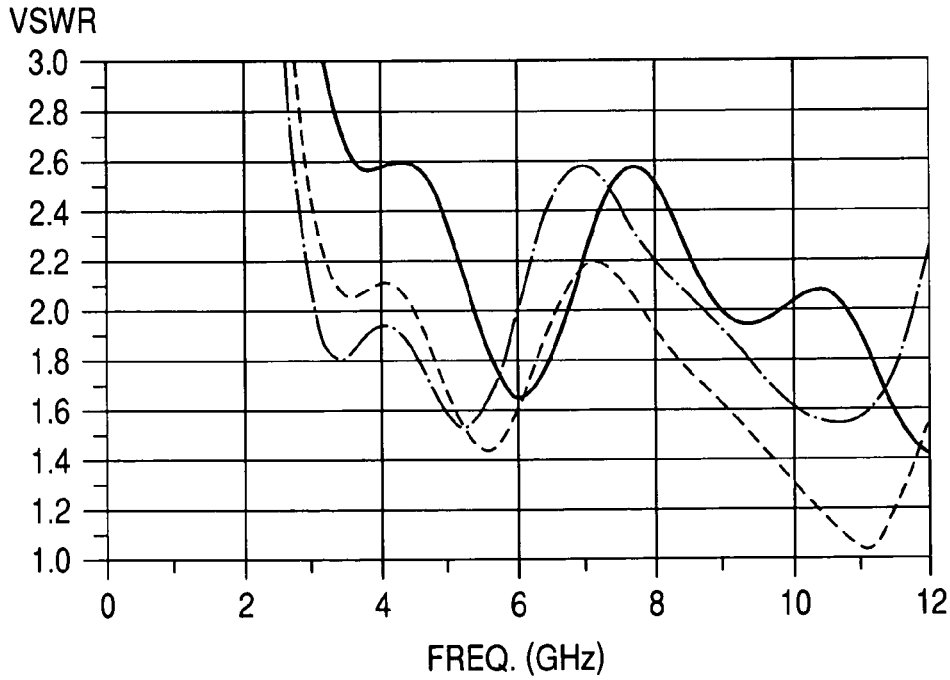
FIG. 25 is a diagram tabulating frequency bands suited for use in this embodiment.
FIG. 26 is a diagram illustrating VSWR characteristics in this embodiment.
Figures 27, 28:
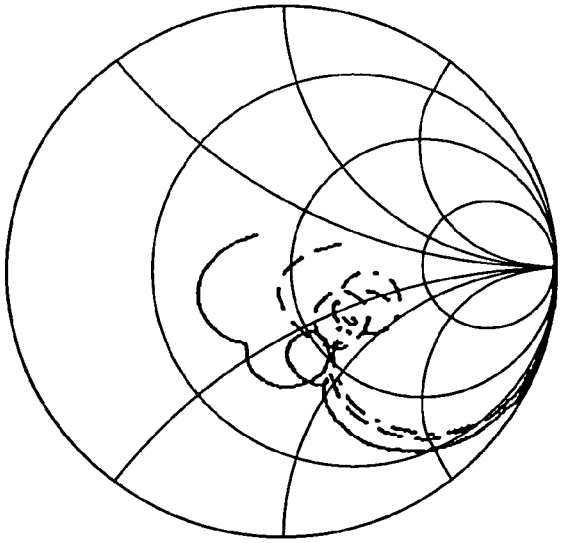
FIG. 27 is a Smith chart in this embodiment.
FIG. 28 is a diagram tabulating frequency bands suited for use in this embodiment.

Here, an example of the antenna device 600 according to this embodiment will be described with reference to FIG. 17 to FIG. 28. FIG. 17 to FIG. 19 are diagrams showing the VSWR characteristics, the Smith chart and the upper and lower limit frequencies suitable for use, in case the length L of the substrate 610 was varied in this embodiment. FIG. 23 to FIG. 25 are diagrams showing the VSWR characteristics, the Smith chart and the upper and lower limit frequencies suitable for use, in case the position of the radiation portion 620 in the shorter side direction of the substrate 610 was varied in this embodiment. FIG. 26 to FIG. 28 are diagrams showing the VSWR characteristics, the Smith chart and the upper and lower limit frequencies suitable for use, in case the distance between the radiation portion 620 and the grounding conductor 650 in the longer side direction of the substrate 610 was varied in this embodiment. Here, the following description uses the reference characters shown in FIG. 14.

For the radiation portion 620, an alumina plate having a thickness of 1 mm was cut out at first as the dielectric material into the base portion 629 having a width Wr1 of 8 mm and a length Wr2 of 10 mm. Then, the cut base portion 629 was printed with the antenna electrode 660 of silver paste in the shape shown in FIG. 16, and was then subjected to a sintering treatment to prepare the radiation portion 620. The substrate 610 had a width W of 40 mm. The distance d1 between the radiation portion 620 and the longer side of the substrate 610 was 2 mm, and the distance d2 in the longer side direction of the substrate 610 between the radiation portion 620 and the grounding conductor 650 was 1 mm. Then, the variations of the characteristics were examined in case the length L of the substrate 610 was varied.

As a result, there were obtained the voltage standing wave ratio (VSWR) characteristics, as shown in FIG. 17, and the Smith chart, as shown in FIG. 18. In FIG. 17 and FIG. 18, solid curves, broken curves and single-dotted curves indicate the VSWR characteristics and the Smith charts of the cases, in which the length L of the substrate 610 was 45 mm, in which the same length L was 70 mm, and in which the same length L was 100 mm. Moreover, the upper and lower limit frequencies suited for use supposing the UWB standards on the basis of the VSWR characteristics shown in FIG. 17 are tabulated in FIG. 19.

As tabulated in FIG. 19, the upper and lower limit frequencies (which are indicated as "SPEC" in FIG. 19, as follows) of the UWB standards are 3,100 MHz for the lower limit frequency and 10,600 MHz for the upper limit frequency. It is found from FIG. 19 that the suitable using condition is satisfied, if set by VSWR<2.5, by the upper and lower frequencies of the UWB standards no matter what value the length L might take. In other words, it is found that a sufficient frequency band width generally matching the UWB standards is retained no matter what value the length L of the substrate 610 might take.

Subsequent examinations were made on the case, in which the width W of the substrate 610 was varied. In these examinations, the pattern of the antenna electrode 660 of the radiation portion 620 was unvaried. However: the length L of the substrate 610 was 45 mm; the distance d1 between the radiation portion 620 and the longer side of the substrate 610 was 2 mm; and the distance d2 in the longer side direction of the substrate 610 between the radiation portion 620 and the grounding conductor 650 was 1 mm. Then, the examinations were made on the variations of the characteristics of the case, in which the width W of the substrate 610 was varied.

Figures 21, 22:
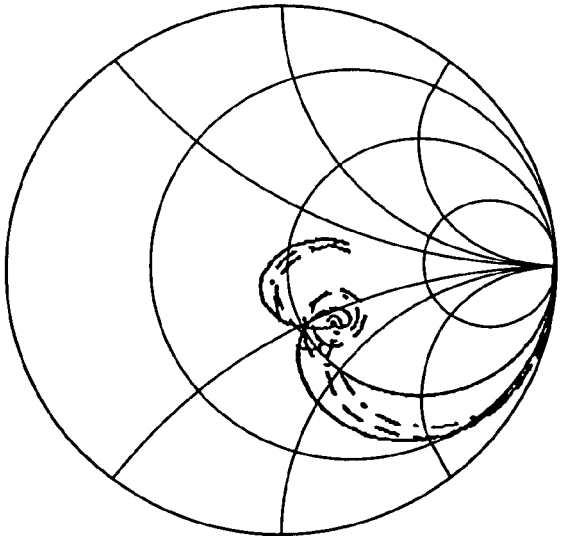
FIG. 21 is a Smith chart in this embodiment.
FIG. 22 is a diagram tabulating frequency bands suited for use in this embodiment.

As a result, there were obtained the VSWR characteristics, as shown in FIG. 20, and the Smith chart, as shown in FIG. 21. In FIG. 20 and FIG. 21, solid curves, broken curves and single-dotted curves indicate the VSWR characteristics and the Smith charts of the cases, in which the width W of the substrate 610 was 30 mm, in which the same width was 40 mm, and in which the same width W was 50 mm. Moreover, the upper and lower limit frequencies suited for use supposing the UWB standards on the basis of the VSWR characteristics shown in FIG. 20 are tabulated in FIG. 22.

As shown in FIG. 20, the VSWR characteristics largely vary with the variation in the width W of the substrate 610. From the viewpoint that the lower limit frequency satisfies the UWB standards, however, it is found from FIG. 22 that satisfactory results were obtained in case the width W was within a range of 30 mm to 50 mm, especially at about 40 mm.

Subsequently, examinations were made on the case, in which the position of the radiation portion 620 on the substrate 610 was varied. At first, the variation in the characteristics was examined by changing the distance d1 between the radiation portion 620 and one longer side of the substrate 610. Without varying the pattern of the antenna electrode 660 of the radiation portion 620, the length L and the width W of the substrate 610 were 45 mm and 40 mm, respectively. Moreover, the distance d2 in the longer side direction of the substrate 610 between the radiation portion 620 and the grounding conductor 650 was 1 mm. Then, the examinations were made on the variations in the characteristics in case the distance d1 between the radiation portion 620 and the longer side of the substrate 610 was varied.

As a result, there were obtained the VSWR characteristics, as shown in FIG. 23, and the Smith chart, as shown in FIG. 24. In FIG. 23 and FIG. 24, solid curves, broken curves and single-dotted curves indicate the VSWR characteristics and the Smith charts of the cases, in which the distance d1 was 2 mm, in which the distance d1 was 9 mm, and in which the distance d1 was 16 mm (i.e., in case the radiation portion 620 is arranged at the center in the shorter side direction of the substrate 610). Moreover, the upper and lower limit frequencies suited for use supposing the UWB standards on the basis of the VSWR characteristics shown in FIG. 23 are tabulated in FIG. 25.

As the distance d1 is varied, as shown in FIG. 23, the VSWR characteristics were also largely varied. In case the distance d1 was 9 mm and 16 mm, as shown in FIG. 25, the standards were dissatisfied for both the upper and lower limit frequencies. As the distance d1 became the less 16 mm, 9 mm and 2 mm, moreover, it is found that the lower limit frequency (of VSWR<2.5) shifted to the lower frequencies of 3,510 MHz, 3,390 MHz and 2,970 MHz, and that the upper limit frequency (of VSWR<2.5) shifted to the higher frequencies of 5,420 MHz, 8,600 MHz and 12,000 MHz. In short, the distance d1 between the radiation portion 620 and one longer side of the substrate 610 can cover the wideband frequencies satisfying the UWB standards, if is made at least 9 mm or less, desirably 2 mm or less.

Next, examinations were made on the variations in the characteristics of the case, in which the distance d2 in the longer side direction of the substrate 610 between the radiation portion 620 and the grounding conductor 650 was varied. The pattern of the antenna electrode 660 of the radiation portion 620 was not changed, but the length L and the width W of the substrate 610 were 45 mm and 40 mm, respectively. Moreover, the distance d1 between the radiation portion 620 and one longer side of the substrate 610 was 2 mm. Then, the variations in the characteristics were examined in case the distance d2 in the substrate face direction between the radiation portion 620 and the grounding conductor 650 was varied.

As a result, there were obtained the VSWR characteristics, as shown in FIG. 26, and the Smith chart, as shown in FIG. 27. In FIG. 26 and FIG. 27, solid curves, broken curves and single-dotted curves indicate the VSWR characteristics and the Smith charts of the cases, in which the distance d2 was 0 mm, in which the distance d2 was 1 mm, and in which the distance d2 was 2 mm. Moreover, the upper and lower limit frequencies suited for use supposing the UWB standards on the basis of the VSWR characteristics shown in FIG. 26 are tabulated in FIG. 28.

As the distance d2 is varied, as shown in FIG. 26, the VSWR characteristics were also largely varied. When the distance d2 was varied 0 mm, 1 mm and 2 mm, it is found that the VSWR characteristics shifted entirely to the lower frequency side. It is, therefore, found that the distance d2 may be enlarged for reducing the lower limit frequency. From the viewpoint of satisfying the UWB standards, on the other hand, it is found from FIG. 28 that the distance d2 is at least 0 mm or more, desirably 1 mm or more.

Figure 29:
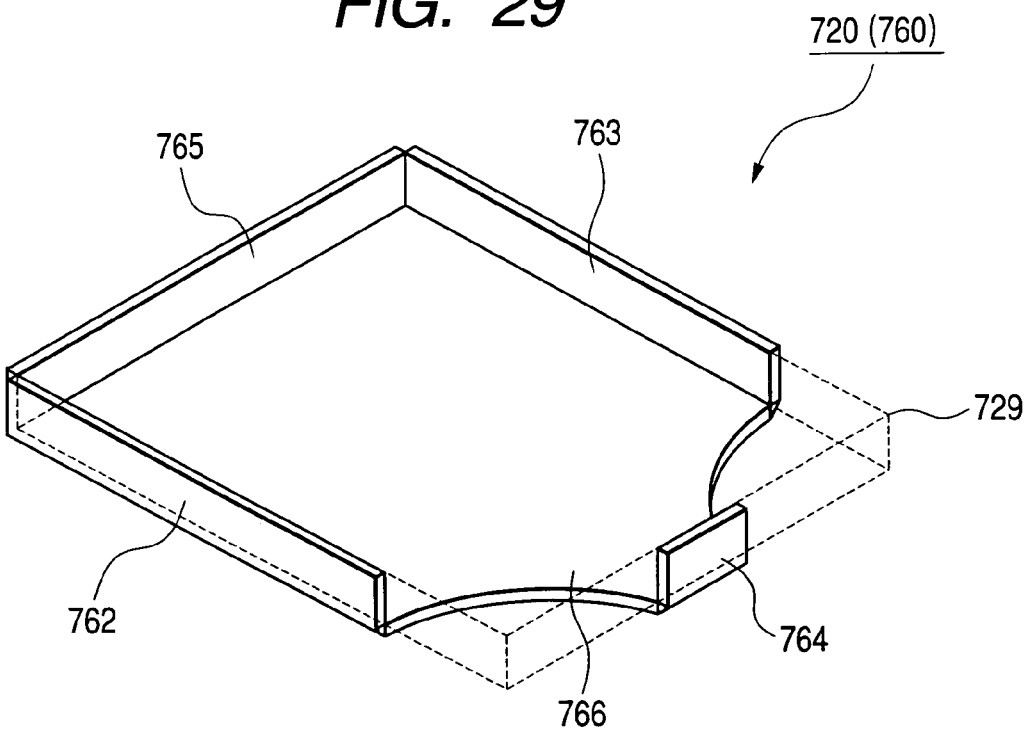
FIG. 29 is a view showing a radiation portion 720 in a seventh embodiment of the invention.
Figure 30:
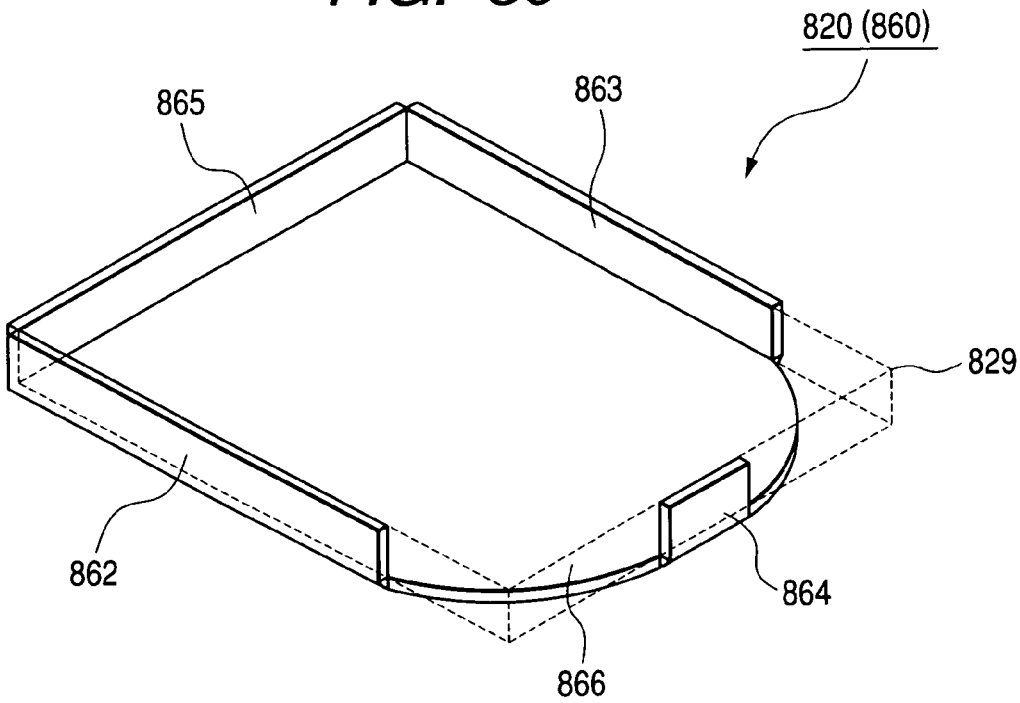
FIG. 30 is a view showing a radiation portion 820 in an eighth embodiment of the invention.

Subsequently, seventh and eighth embodiments of the antenna device according to the invention will be described in detail with reference to FIG. 14, FIG. 15, FIG. 29 and FIG. 30. FIG. 29 is a perspective view showing a construction of a radiation portion 720 in the seventh embodiment of the invention, and FIG. 30 is a perspective view showing a construction of a radiation portion 820 in the eighth embodiment of the invention. Here in FIG. 29 and FIG. 30, base portions 729 and 829 are shown by broken lines so that the shapes of antenna electrodes 760 and 860 may be easily understood.

In the seventh and eighth embodiments according to the invention, the radiation portion 620 in the antenna device 600 according to the sixth embodiment is replaced by the radiation portion 720 and the radiation portion 820 shown in FIG. 29 and FIG. 30, respectively. Therefore, the description will be omitted on the portions common to those of the sixth embodiment.

In the radiation portions 720 and 820 in these embodiments, as shown in FIG. 29 and FIG. 30, electrodes 762 to 766 and electrodes 862 to 866 are formed on the five faces of the base portions 729 and 829 excepting the top face so that they form the antenna electrodes 760 and 860, respectively, altogether. Specifically, the electrodes 762 to 766 and the electrodes 862 to 866 are formed on the two side faces, front faces, back faces and bottom faces of the respective base portions 729 and 829. On the other hand, the electrodes 766 and 866 formed on the bottom faces of the base portions 729 and 829 are formed in such arcuate shapes that their regions are gradually widened from the sides contacting with the electrodes 764 and 864 toward the electrodes 762 and 763 and the electrodes 862 and 863 formed on the two side faces of the base portions 729 and 829, respectively. Here, what is different between the seventh embodiment and the eighth embodiment is the directions of the arcs. Specifically, the arcs of the electrode 766 in the seventh embodiment are made concave, and the arcs of the electrode 866 in the eighth embodiment are made convex.

Figure 31:
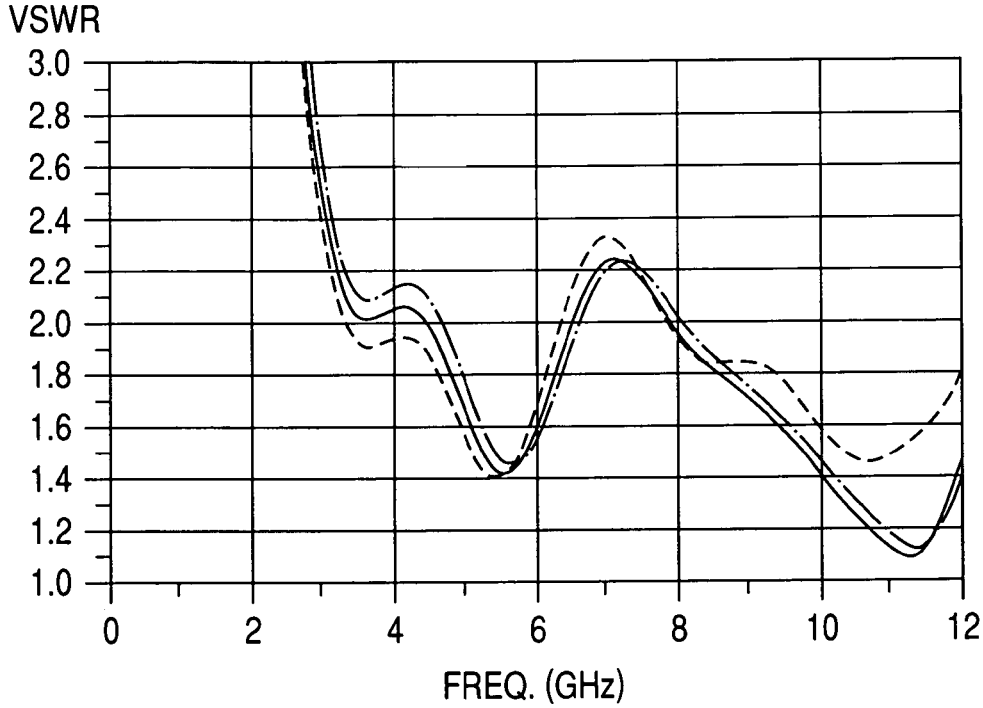
FIG. 31 is a diagram illustrating VSWR characteristics in this embodiment.
Figure 32:
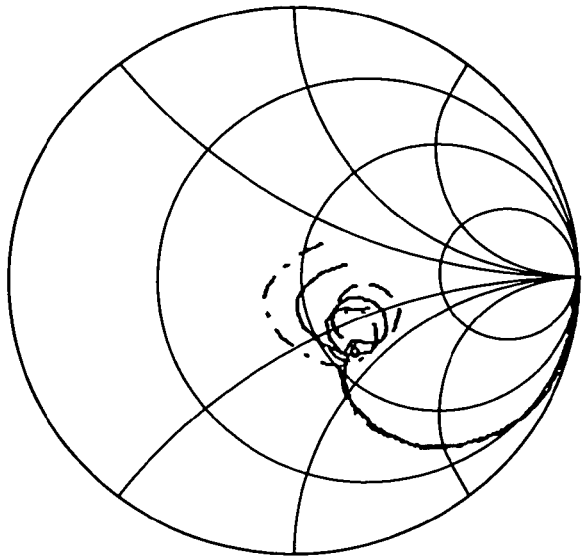
FIG. 32 is a Smith chart in this embodiment.
Figures 33, 34:
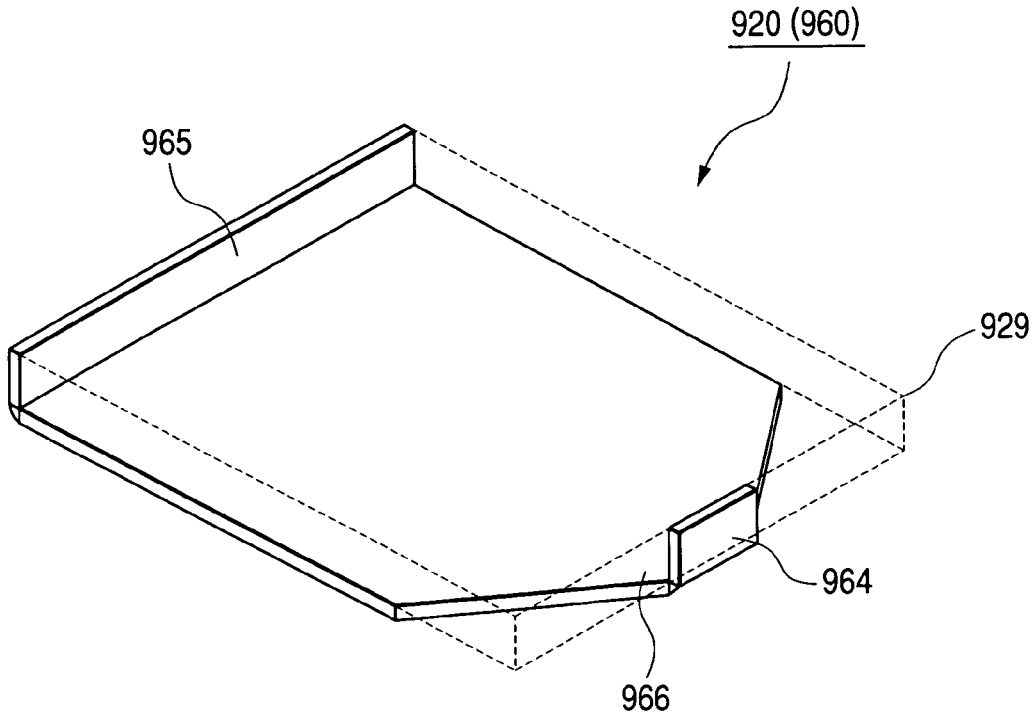
FIG. 33 is a diagram tabulating frequency bands suited for use in this embodiment.
FIG. 34 is a view showing a radiation portion 920 in a ninth embodiment of the invention.

Here, examples of the antenna devices according to the seventh and eighth embodiments will be described with reference to FIG. 31 to FIG. 33. FIG. 31 to FIG. 33 are diagrams showing the VSWR characteristics, the Smith chart and the upper and lower limit frequencies suitable for use such that they contrast the sixth to eighth embodiments individually.

For the radiation portions 720 and 820, an alumina plate having a thickness of 1 mm was cut out at first as the dielectric material into the base portions 729 and 829 having a width Wr1 of 8 mm and a length Wr2 of 10 mm. Then, the cut base portions 729 and 829 were printed with the antenna electrodes 760 and 860 of silver paste in the shapes shown in FIG. 29 and FIG. 30, and were then subjected to a sintering treatment to prepare the radiation portions 720 and 820. Substrates 710 and 810 had a width W of 40 mm and a length L of 45 mm. The distance d1 between the radiation portions 720 and 820 and the individual longer sides of the substrates 710 and 810 was 2 mm, and the distance d2 in the longer side directions of the substrates between the radiation portions 720 and 820 and grounding conductors 750 and 850 was 1 mm. Then, the differences in the characteristics were examined together with the radiation portion 620 of the sixth embodiment as a comparison example.

As a result, there were obtained the VSWR characteristics, as shown in FIG. 31, and the Smith chart, as shown in FIG. 32. In FIG. 31 and FIG. 32, solid curves, broken curves and single-dotted curves indicate the VSWR characteristics and the Smith charts of the sixth embodiment, the seventh embodiment and the eighth embodiment. Moreover, the upper and lower limit frequencies suited for use supposing the UWB standards on the basis of the VSWR characteristics shown in FIG. 31 are tabulated in FIG. 33.

As seen from FIG. 31, the VSWR characteristics were hardly different, if any, among the radiation portions 620, 720 and 820. As tabulated in FIG. 33, moreover, any of the radiation portions could achieve a large frequency band width satisfying the UWB standards.

Figure 35:
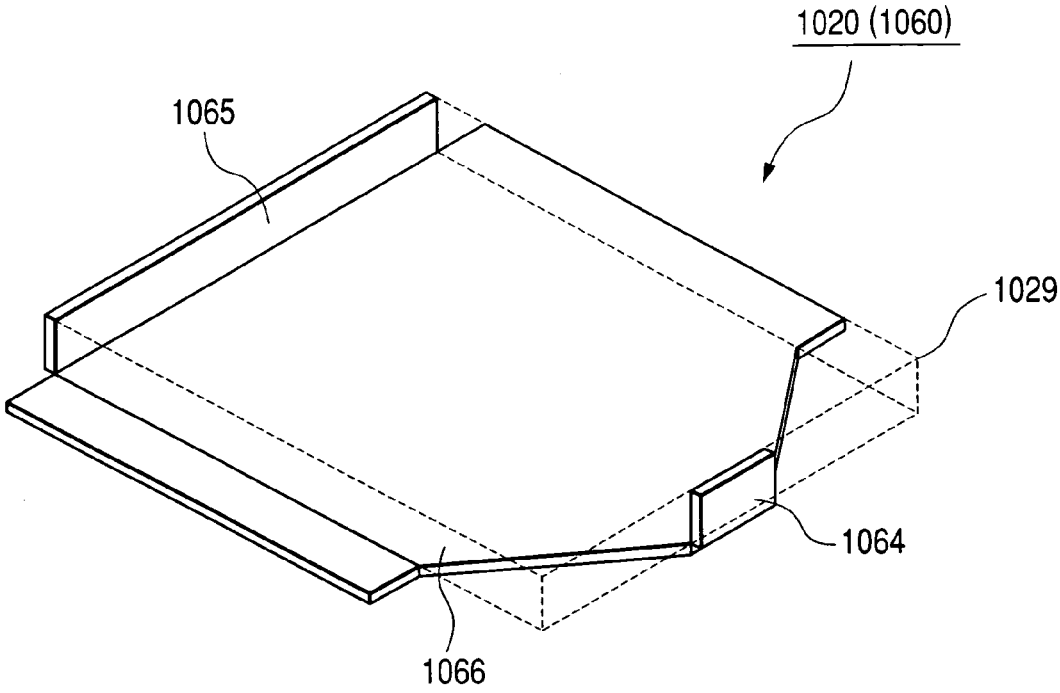
FIG. 35 is a view showing a radiation portion 1020 in a tenth embodiment of the invention.

Subsequently, ninth and tenth embodiments of the antenna device according to the invention will be described in detail with reference to FIG. 14, FIG. 15, FIG. 34 and FIG. 35. FIG. 34 is a perspective view showing a construction of a radiation portion 920 in the ninth embodiment of the invention, and FIG. 35 is a perspective view showing a construction of a radiation portion 1020 in the tenth embodiment of the invention. Here in FIG. 34 and FIG. 35, base portions 929 and 1029 are shown by broken lines.

In the ninth and tenth embodiments according to the invention, the radiation portion 620 in the antenna device 600 according to the sixth embodiment is replaced by the radiation portion 920 and the radiation portion 1020 shown in FIG. 34 and FIG. 35, respectively. Therefore, the description will be omitted on the portions common to those of the sixth embodiment.

In the radiation portions 920 and 1020 in these embodiments, as shown in FIG. 34 and FIG. 35, electrodes 964 to 966 and electrodes 1064 to 1066 are formed only on the front faces, back faces and bottom faces of the base portions 929 and 1029, respectively. In the ninth embodiment, more specifically, the electrodes, which correspond to the electrodes 662 and 663 formed on the side faces 622 and 623 of the radiation portion 620 according to the sixth embodiment shown in FIG. 16, respectively, are omitted. In the tenth embodiment, the same corresponding electrodes are developed and integrated with the electrode 1066. On the other hand, it is common to the electrode 666 in the sixth embodiment that both the electrodes 966 and 1066 to be formed on the base faces of the base portions 929 and 1029 are linearly formed at the angle of inclination θ (or linearly formed at the center angle ϕ)

Figure 36:
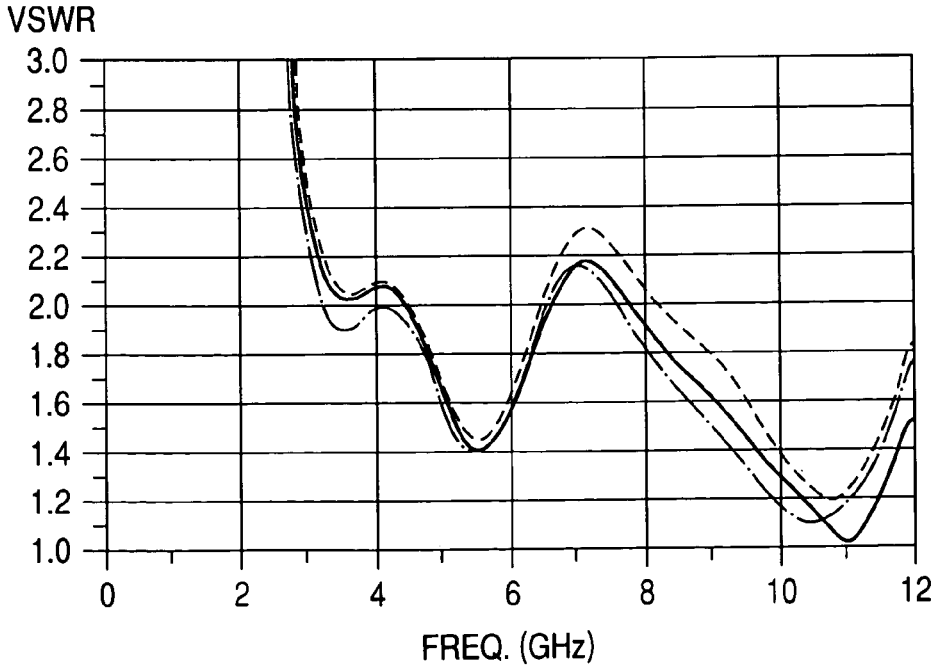
FIG. 36 is a diagram illustrating VSWR characteristics in this embodiment.
Figures 37, 38:
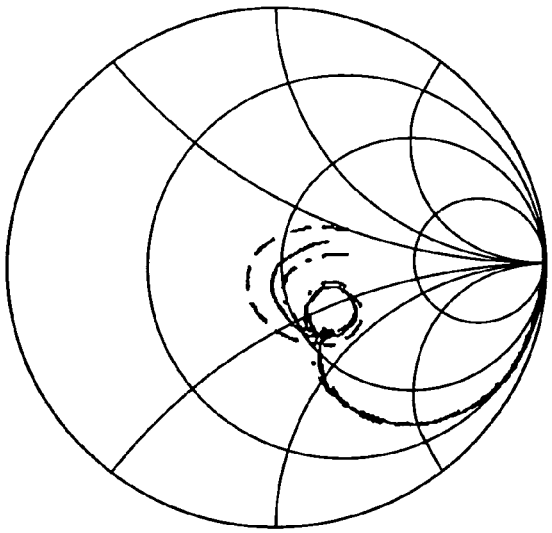
FIG. 37 is a Smith chart in this embodiment.
FIG. 38 is a diagram tabulating frequency bands suited for use in this embodiment.

Here, examples of the antenna devices according to the ninth and tenth embodiments will be described with reference to FIG. 36 to FIG. 38. FIG. 36 to FIG. 38 are diagrams showing the VSWR characteristics, the Smith chart and the upper and lower limit frequencies suitable for use such that they contrast the sixth, ninth and tenth embodiments individually.

Here, the sizes of the radiation portion, the sizes of the substrate and the position of the radiation portion in the substrate were set under the same conditions as those of the examples of the seventh and eighth embodiments, and the characteristics were examined together with the radiation portion 620 of the sixth embodiment as a comparison example.

As a result, there were obtained the VSWR characteristics, as shown in FIG. 36, and the Smith chart, as shown in FIG. 37. In FIG. 36 and FIG. 37, solid curves, broken curves and single-dotted curves indicate the VSWR characteristics and the Smith charts of the sixth embodiment, the ninth embodiment and the tenth embodiment. Moreover, the upper and lower limit frequencies suited for use supposing the UWB standards on the basis of the VSWR characteristics shown in FIG. 36 are tabulated in FIG. 38.

As seen in FIG. 36, the VSWR characteristics were slightly different among the radiation portions 620, 920 and 1020. Especially the tenth embodiment is slightly but more shifted in the frequency band toward the lower frequency side than the sixth and ninth embodiments. Moreover, the ninth embodiment is deteriorated in the VSWR characteristics on the high frequency side. As tabulated in FIG. 38, moreover, the tenth embodiment is lower in the lower limit frequency than the sixth and ninth embodiments, and it is found that the wider frequency band could be retained.

Figure 39:
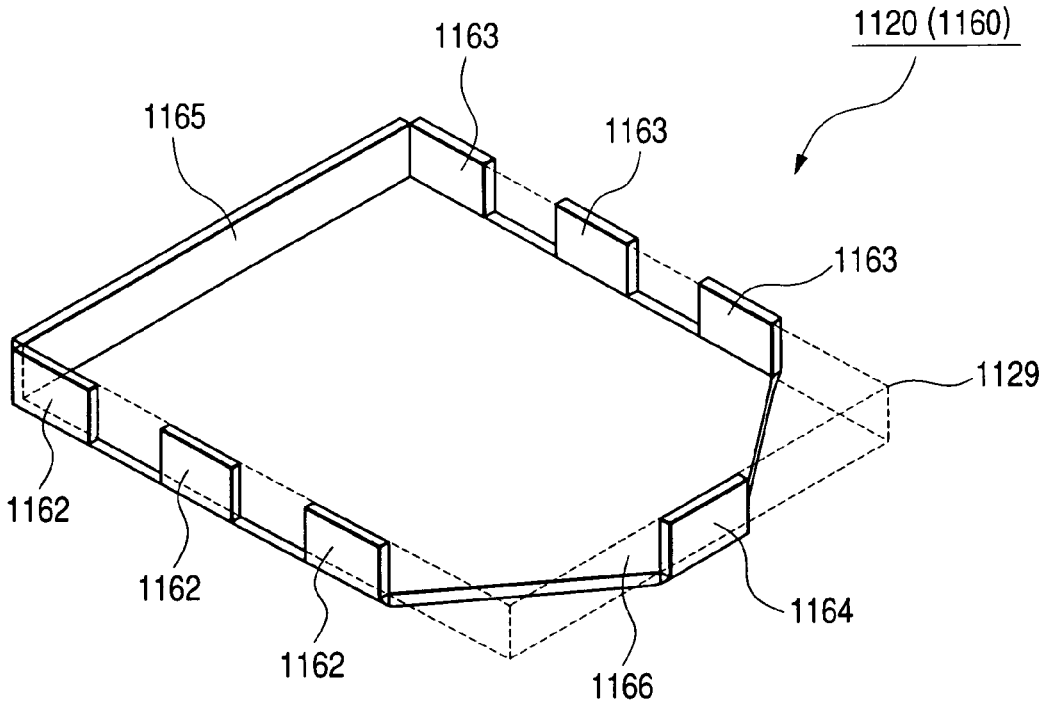
FIG. 39 is a view showing a radiation portion 1120 in an eleventh embodiment of the invention.

Subsequently, an eleventh embodiment of the antenna device according to the invention will be described in detail with reference to FIG. 14, FIG. 15 and FIG. 39. FIG. 39 is a perspective view showing a construction of a radiation portion 1120 in the eleventh embodiment of the invention. Here in FIG. 39, a base portion 1129 is shown by broken lines.

In the eleventh embodiment according to the invention, the radiation portion 620 in the antenna device 600 according to the sixth embodiment is replaced by the radiation portion 1120 shown in FIG. 39, respectively. Therefore, the description will be omitted on the portions common to those of the sixth embodiment.

In the radiation portion 1120 in this embodiment, as shown in FIG. 39, electrodes 1162 to 1166 are formed on the five faces of the base portion 1129 excepting the top face so that they construct an antenna electrode 1160 integrally altogether. Specifically, the electrodes 1162 to 1166 are individually formed on the two side faces, front face, back face and bottom face of the base portion 1129. As compared with the radiation portion 620 of the sixth embodiment, the radiation portion 1120 of this embodiment is different only in that slits are formed in the electrode 1162 and the electrode 1163 formed on the two side faces of the base portion 1129.

Figure 40:
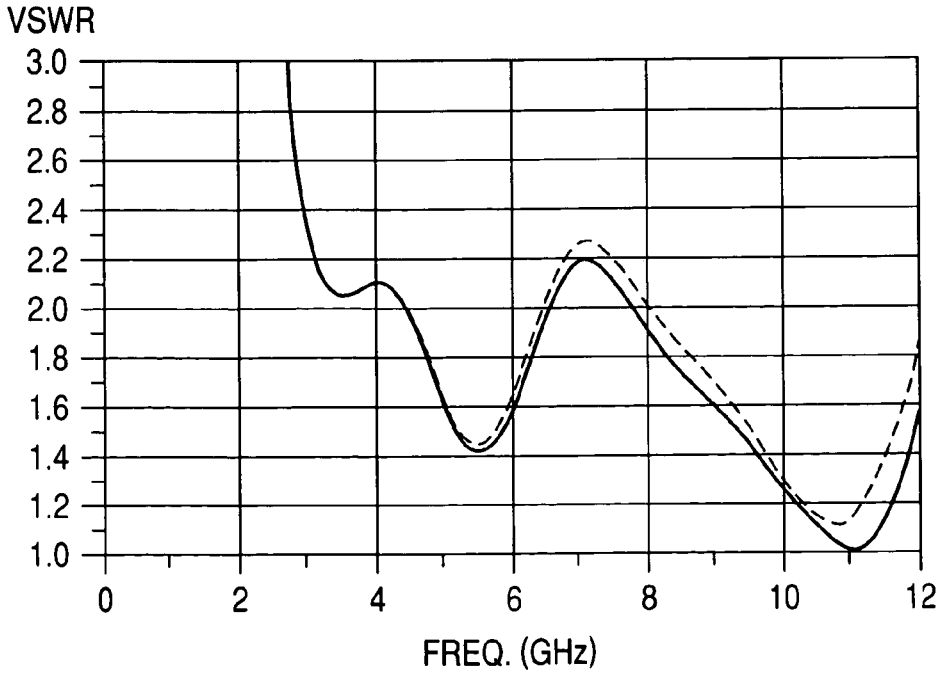
FIG. 40 is a diagram illustrating VSWR characteristics in this embodiment.
Figures 41, 42:
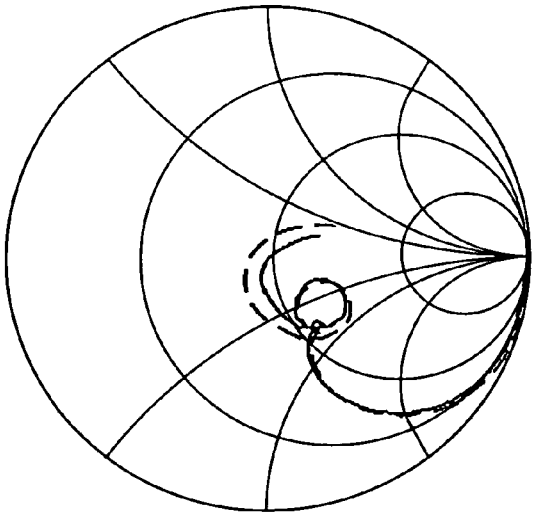
FIG. 41 is a Smith chart in this embodiment.
FIG. 42 is a diagram tabulating frequency bands suited for use in this embodiment.

Here, examples of the antenna devices according to the sixth and ninth embodiments will be described with reference to FIG. 40 to FIG. 42. FIG. 40 to FIG. 42 are diagrams showing the VSWR characteristics, the Smith chart and the upper and lower limit frequencies suitable for use such that they contrast the sixth and eleventh embodiments individually.

Here, the sizes of the radiation portion, the sizes of the substrate and the position of the radiation portion in the substrate were set under the same conditions as those of the examples of the seventh to tenth embodiments. In the electrodes 1162 and 1163 of the radiation portion 1120, there were individually formed two slits, which had widths of one fifth of the width of those electrodes. Here, the characteristics were examined together with the radiation portion 620 of the sixth embodiment as a comparison example.

As a result, there were obtained the VSWR characteristics, as shown in FIG. 40, and the Smith chart, as shown in FIG. 41. In FIG. 40 and FIG. 41, solid curves and broken curves indicate the VSWR characteristics and the Smith charts of the sixth embodiment and the eleventh embodiment. Moreover, the upper and lower limit frequencies suited for use supposing the UWB standards on the basis of the VSWR characteristics shown in FIG. 40 are tabulated in FIG. 42.

As seen from FIG. 40, the VSWR characteristics were hardly different, if any, between the radiation portions 620 and 1120. As tabulated in FIG. 42, moreover, any of the radiation portions could achieve a large frequency band width satisfying the UWB standards.

Here, other examples of the antenna devices according to the first to sixth embodiments of the invention will be described with reference to FIG. 43 to FIG. 48. FIG. 43 to FIG. 48 are diagrams showing the VSWR characteristics, the Smith charts and the upper and lower limit frequencies suitable for use on other examples of the first to sixth embodiments. In these examples, the examinations were made on the variations of characteristics of the cases, in which the antenna electrodes to construct the radiation portion are formed on all the five faces excepting the bottom face to contact with the substrate, as shown in FIG. 4, and are formed on the bottom face to contact with the substrate and on all the four faces (i.e., all the faces excepting the top face) being adjacent to the bottom face.

For the radiation portion 120 in the first embodiment, an alumina plate having a thickness of 2 mm was cut out at first as the dielectric material into the base portion 129 having a width Wr1 of 12 mm and a length Wr2 of 12 mm. Then, the cut base portion 129 was printed with the antenna electrode 160 of silver paste in the shape (as will be called the "upper open type") shown in FIG. 16 and in the shape (as will be called the "lower open type") shown in FIG. 4, and was then subjected to a sintering treatment to prepare two kinds of radiation portions 120. The substrate 110 had a thickness of 1 mm, the width W of 40 mm and a length L of 100 mm. The distance d between the radiation portion 120 and the longer side of the substrate 110 was 19 mm (the radiation portion 120 was at the center in the shorter side direction of the substrate), and the distance in the longer side direction of the substrate between the radiation portion 120 and the grounding conductor 150 was 0 mm.

Figure 43:
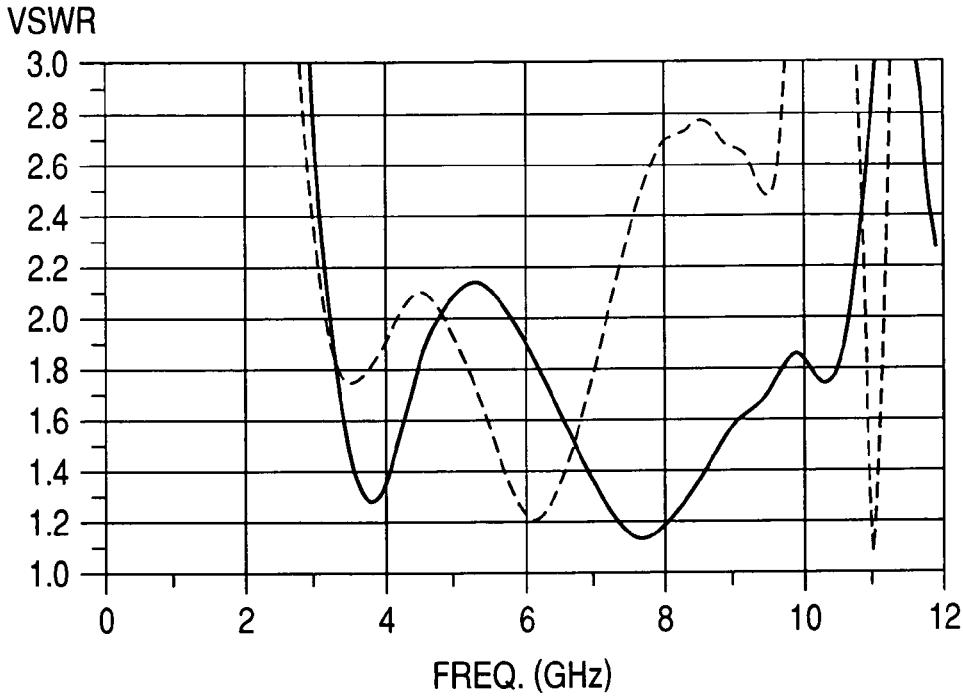
FIG. 43 is a diagram illustrating VSWR characteristics of a modification of the first embodiment of the invention.
Figure 44:
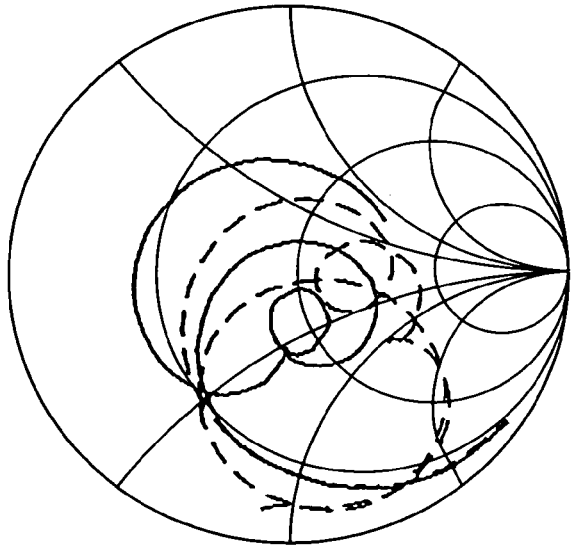
FIG. 44 is a Smith chart showing the modification of the first embodiment of the invention.

As a result, there were obtained the VSWR characteristics, as shown in FIG. 43, and the Smith chart, as shown in FIG. 44. In FIG. 43 and FIG. 44, solid curves and broken curves indicate the VSWR characteristics and the Smith charts of the cases, in which the electrode 160 of the radiation portion 120 was the upper open type and in which the same was the lower open time. Moreover, the upper and lower limit frequencies suited for use supposing the UWB standards on the basis of the VSWR characteristics shown in FIG. 43 are tabulated in FIG. 45. Under the conditions of these embodiments, sufficiently wideband characteristics could be obtained for the upper open type, as shown in FIG. 43 and FIG. 45.

Subsequently, for the radiation portion 620 in the sixth embodiment, an alumina plate having a thickness of 1 mm was cut out as the dielectric material into the base portion 629 having a width Wr1 of 8 mm and a length Wr2 of 10 mm. Then, the cut base portion 629 was printed with the antenna electrode 660 of silver paste in the upper open type and the lower open type shown in FIG. 16 and FIG. 4, and was then subjected to a sintering treatment to prepare the radiation portions 620 of two kinds. The substrate 610 had a thickness of 1 mm, a width W of 40 mm and a length L of 45 mm. The distance d1 between the radiation portion 620 and the longer side of the substrate 610 was 2 mm, and the distance d2 in the longer side direction of the substrate 610 between the radiation portion 620 and the grounding conductor 650 was 1 mm.

Figures 45, 46:
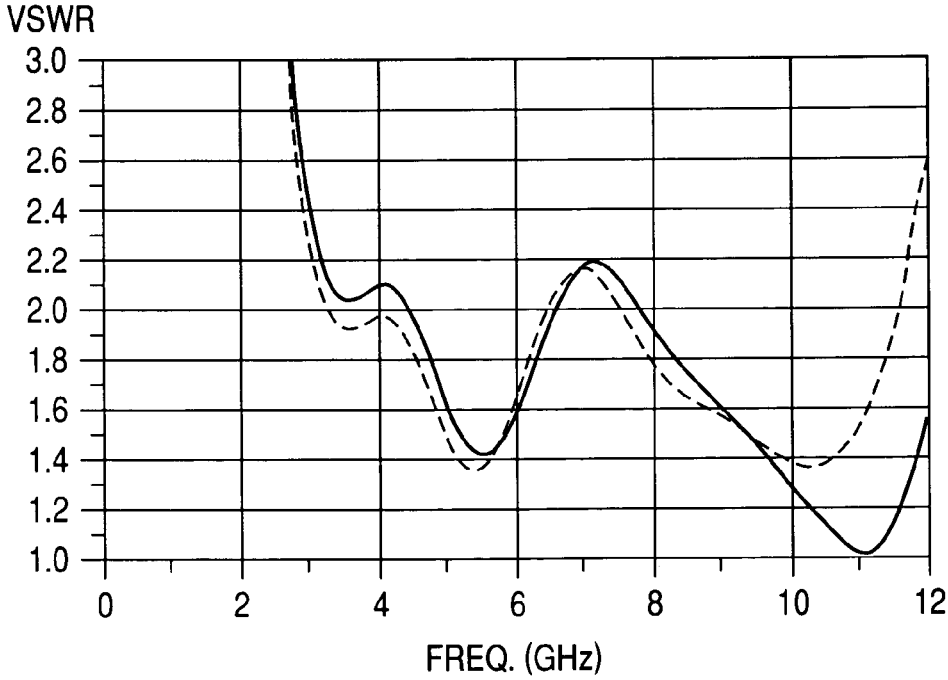
FIG. 45 is a diagram tabulating frequency bands suited for use in the modification of the first embodiment of the invention.
FIG. 46 is a diagram illustrating VSWR characteristics of a modification of the sixth embodiment of the invention.
Figures 47, 48:
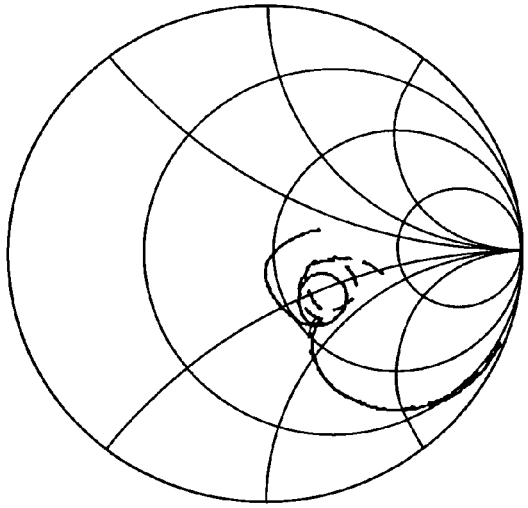
FIG. 47 is a Smith chart showing the modification of the sixth embodiment of the invention.
FIG. 48 is a diagram tabulating frequency bands suited for use in the modification of the sixth embodiment of the invention.
Figure 49:
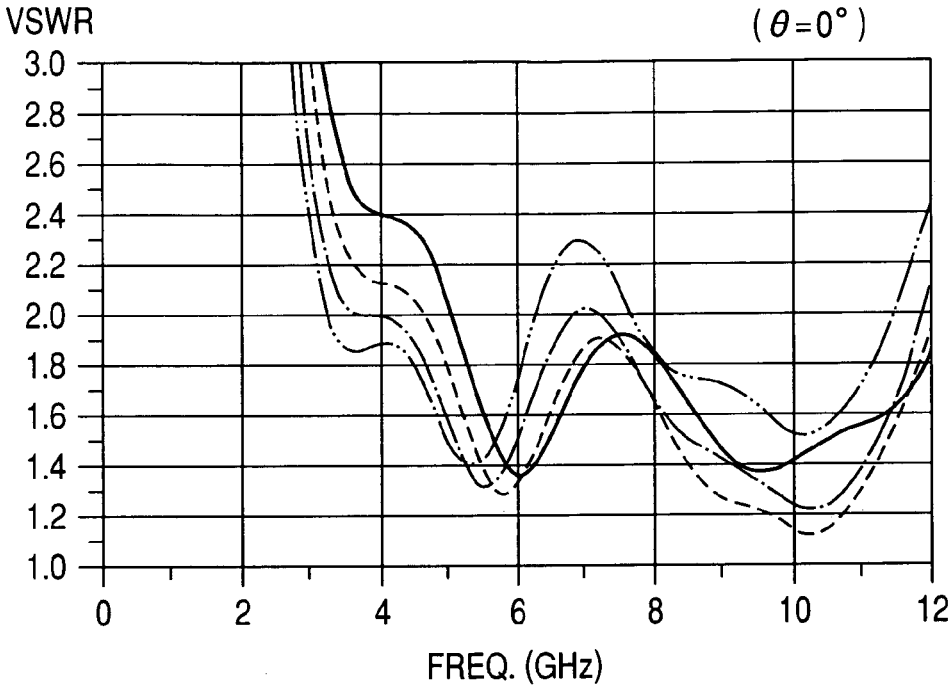
FIG. 49 is a diagram illustrating VSWR characteristics of another modification of the sixth embodiment of the invention.
Figure 50:
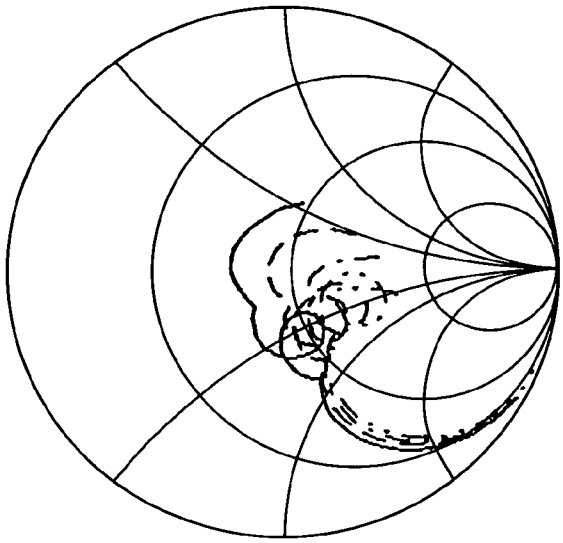
FIG. 50 is a Smith chart showing that another modification of the sixth embodiment of the invention.
Figure 51:
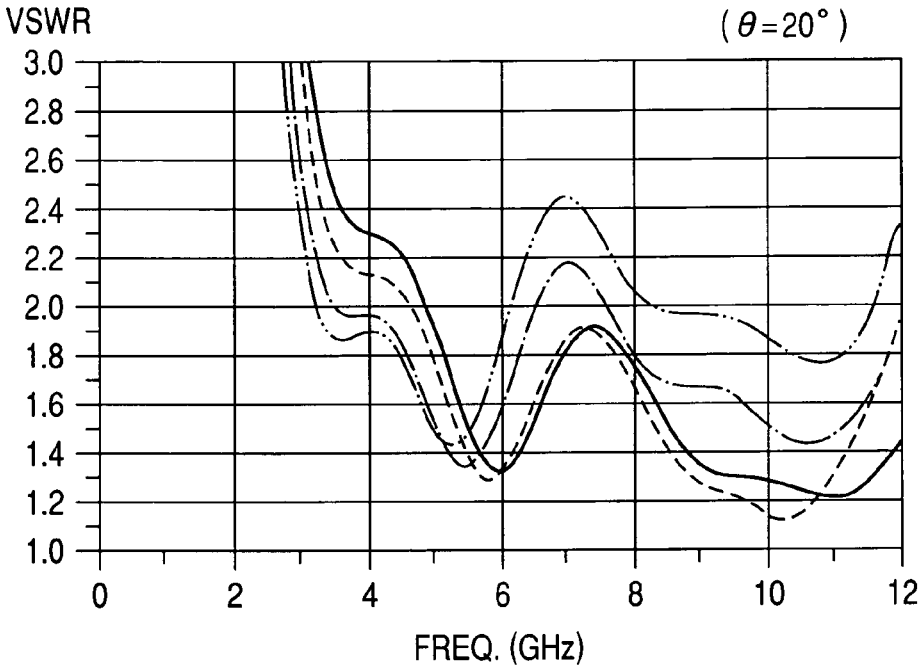
FIG. 51 is a diagram illustrating VSWR characteristics of another modification of the sixth embodiment of the invention.
Figure 52:
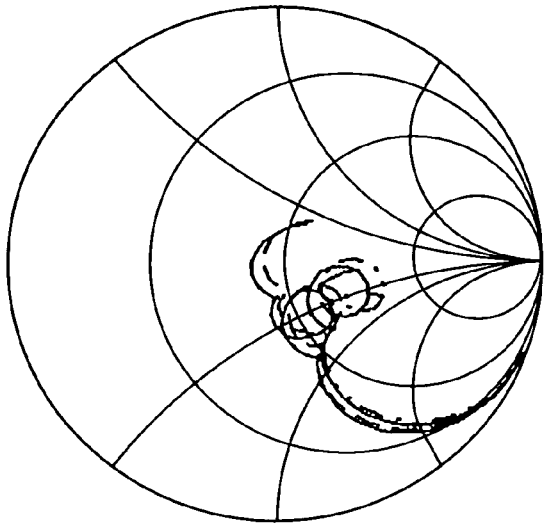
FIG. 52 is a Smith chart showing that another modification of the sixth embodiment of the invention.
Figure 53:
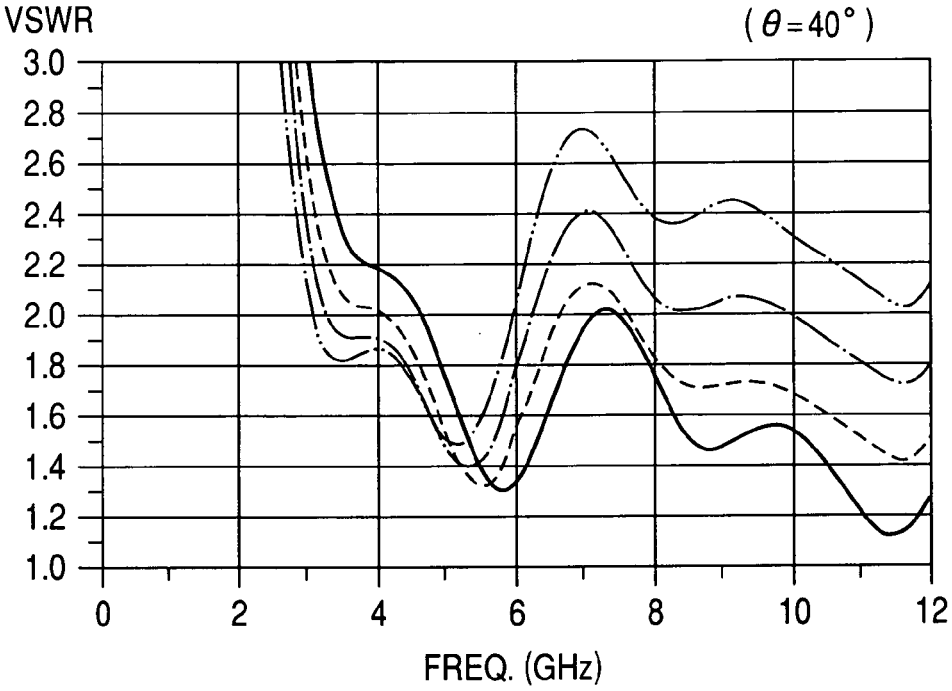
FIG. 53 is a diagram illustrating VSWR characteristics of another modification of the sixth embodiment of the invention.
Figure 54:
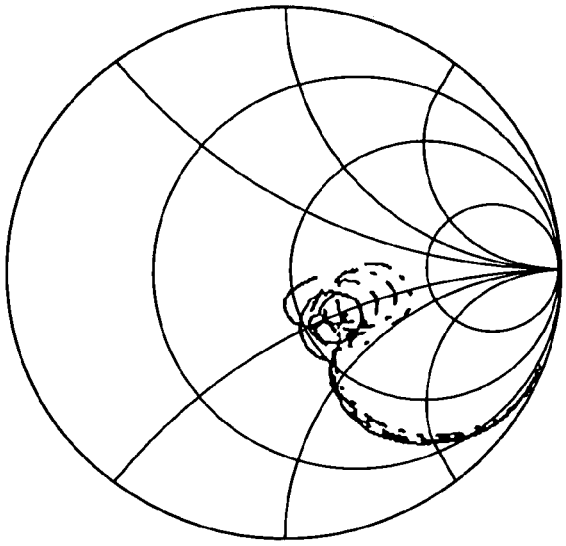
FIG. 54 is a Smith chart showing that another modification of the sixth embodiment of the invention.
Figure 55:
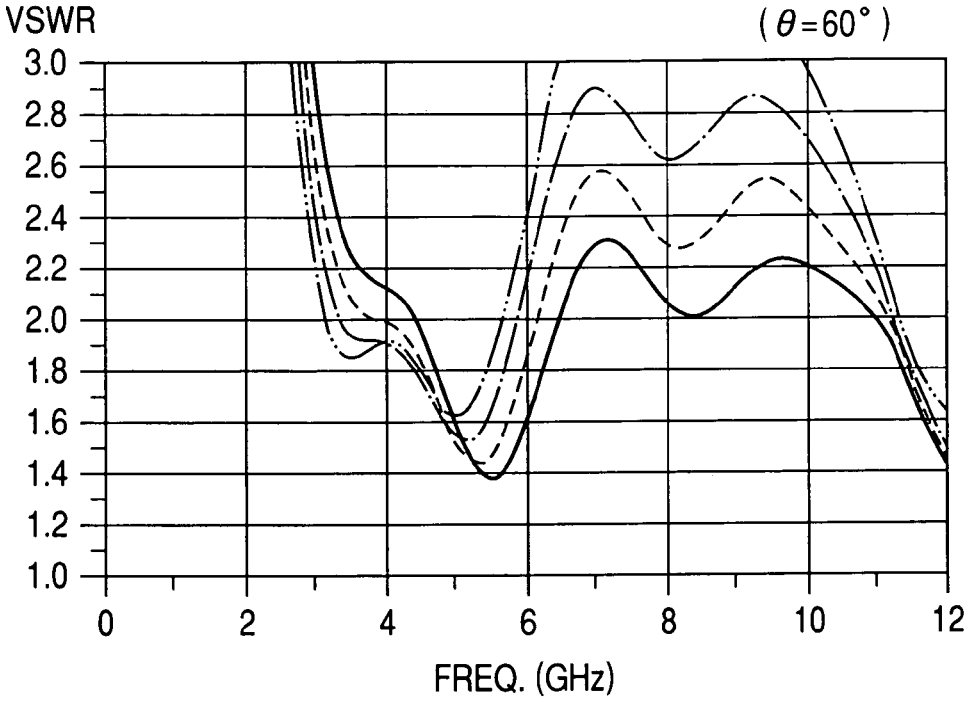
FIG. 55 is a diagram illustrating VSWR characteristics of another modification of the sixth embodiment of the invention.
Figure 56:
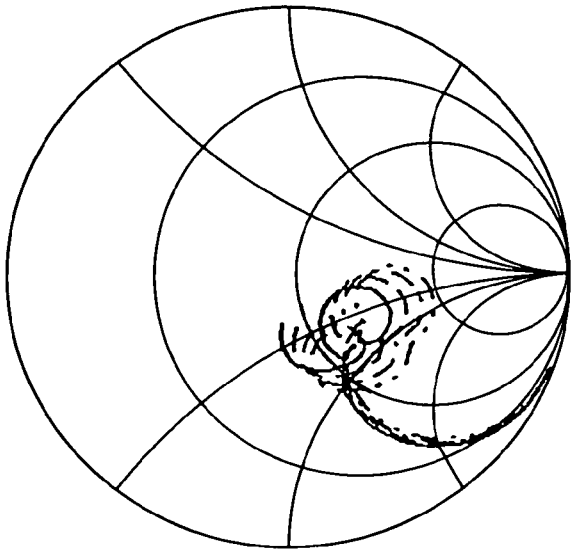
FIG. 56 is a Smith chart showing that another modification of the sixth embodiment of the invention.
Figure 58:
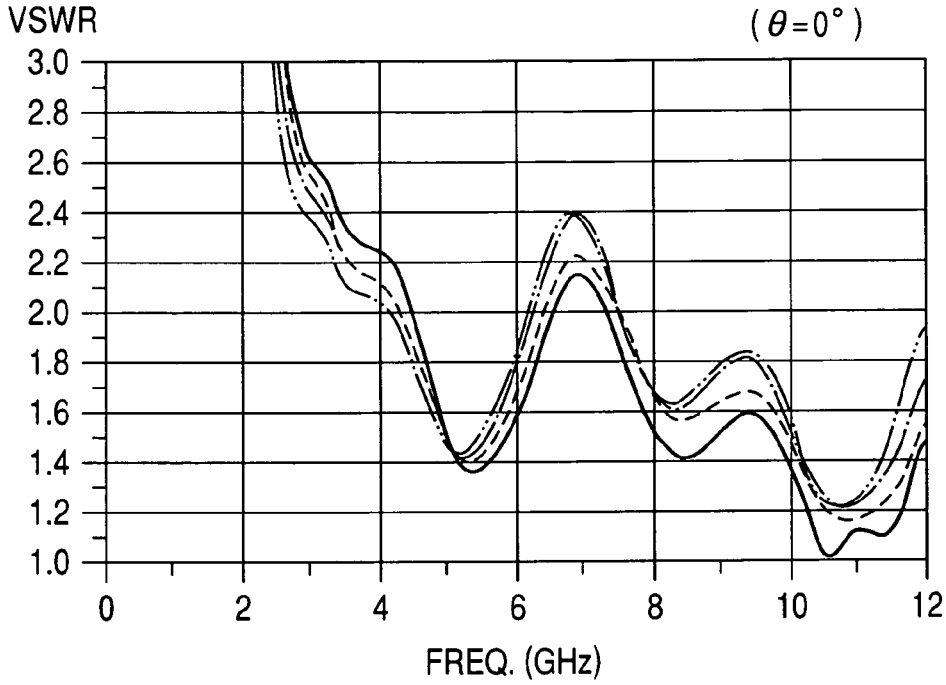
FIG. 58 is a diagram illustrating VSWR characteristics of another modification of the sixth embodiment of the invention.

As a result, there were obtained the VSWR characteristics, as shown in FIG. 46, and the Smith chart, as shown in FIG. 47. In FIG. 46 and FIG. 47, solid curves and broken curves indicate the VSWR characteristics and the Smith charts of the cases, in which the electrode 660 of the radiation portion 620 was the upper open type and in which the same was the lower open time. Moreover, the upper and lower limit frequencies suited for use supposing the UWB standards on the basis of the VSWR characteristics shown in FIG. 46 are tabulated in FIG. 48. Under the conditions of these embodiments, sufficient wideband characteristics could be obtained for both the upper open type and the lower open type, as shown in FIG. 46. In case the radiation portion 620 was formed in the lower open type, on the other hand, the result was that both the lower limit frequency and the upper limit frequency shifted to the lower frequency side.

Next, other examples of the antenna device according to the sixth embodiment will be described with reference to FIG. 49 to FIG. 64. FIG. 49 to FIG. 64 are diagrams showing the VSWR characteristics, the Smith charts and the upper and lower limit frequencies suitable for use of the cases, in which the angle of inclination θ of the antenna electrode 660 formed on the radiation portion 620 and the distance d2 in the longer side direction of the substrate 610 between the radiation portion 620 and the grounding conductor 650 are varied.

For the radiation portion 620 shown in FIG. 14, an alumina plate having a thickness of 0.8 mm was cut out at first as the dielectric material into the base portion 629 having a width Wr1 of 8 mm and a length Wr2 of 8 mm. Then, the cut base portion 629 was printed with the antenna electrode 660 of silver paste in the shape shown in FIG. 16, and was then subjected to a sintering treatment to prepare the radiation portion 620. At this time, the width (or the length in the direction of the width W) of the electrode 664 was 2 mm. The substrate 610 had a width W of 40 mm and a length L of 45 mm, and the distance d1 between the radiation portion 620 and the longer side of the substrate 610 was 2 mm. Then, the variations of the characteristics were examined by varying the distance d2 in the longer side direction of the substrate 610 between the radiation portion 620 and the grounding conductor 650, and the inclination angle θ of the electrode 666.

As a result, the VSWR characteristics and the Smith charts were obtained, as shown in FIG. 49 to FIG. 56. FIG. 49, FIG. 51, FIG. 53 and FIG. 55, and FIG. 50, FIG. 52, FIG. 54 and FIG. 56 are diagrams showing the VSWR characteristics and the Smith charts of the cases, in which the inclination angle θ was 0 degrees, 20 degrees, 40 degrees and 60 degrees. The solid curves indicate the case, in which the distance d2 was 1.0 mm; the broken curves indicate the case, in which the same was 1.5 mm; and single-dotted curves indicate the case, in which the same was 2.5 mm. On the other hand, FIG. 57 indicates the upper and lower limit frequencies suitable for use, as obtained from those results.

As shown in FIG. 49 to FIG. 56, it is found that the VSWR characteristics in the high frequency band were the better for the shorter distance d2 but the VSWR characteristics in the low frequency band were the worse. In case the distance d2 was constant, as shown in FIG. 57, on the other hand, it is found that the lower limit frequency is the lower for the larger inclination angle θ. From the viewpoint of satisfying the condition of VSWR<2.5 for the wide band from the lower limit frequency of 3,100 MHz to the upper limit frequency of 10,600 MHz, on the other hand, it is found that the distance d2 is suitable within a range of 1.5 mm to 2.5 mm, desirably about 2 mm, and that the inclination angle θ is desired within a range of 0 degrees to 40 degrees. In other words, a satisfactory result is obtained, if the electrode 660 is formed in such a radial shape as has a center angle ϕ of 100 degrees (180−40×2) degrees or more to 180 degrees (180−0×2) or less with respect to a straight line directed from the electrode 664 (or one end of the electrode 660) or the feeding point toward the opposed electrode 665 (or the other end of the electrode 660).

Figure 59:
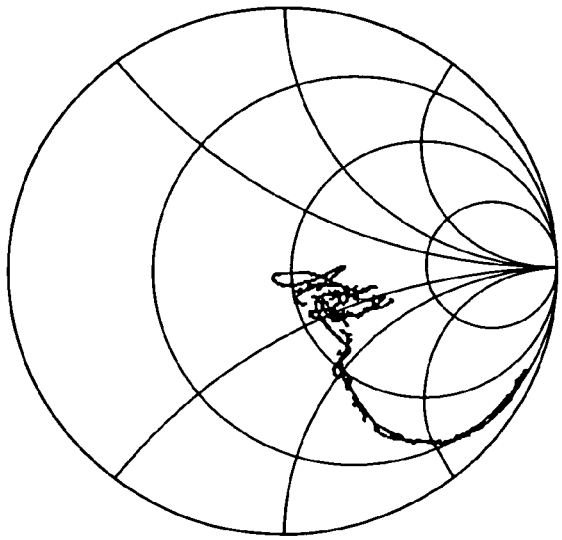
FIG. 59 is a Smith chart showing that another modification of the sixth embodiment of the invention.
Figure 60:
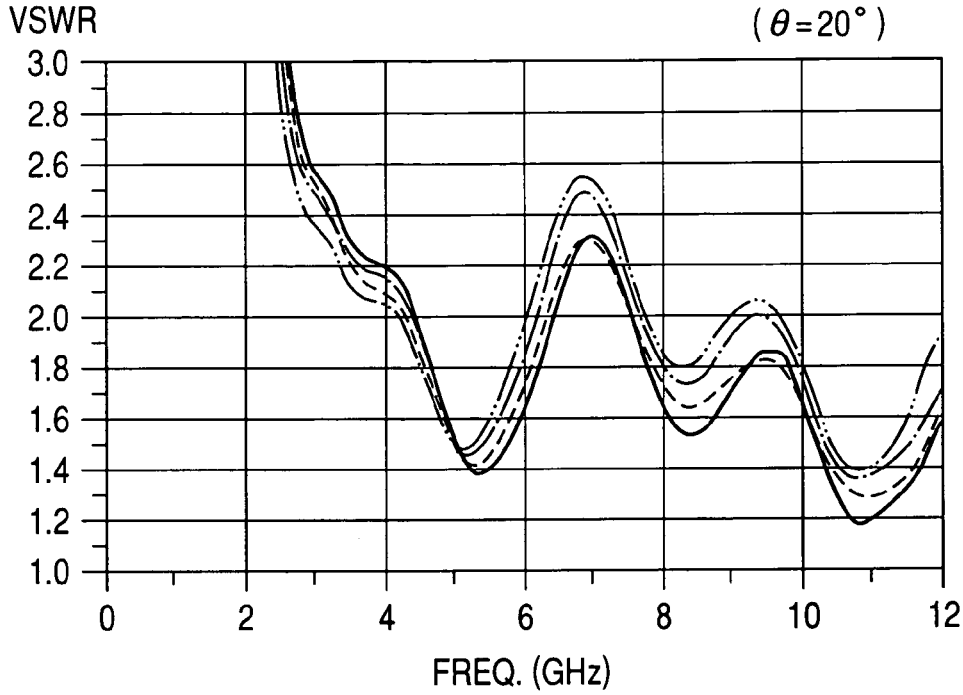
FIG. 60 is a diagram illustrating VSWR characteristics of another modification of the sixth embodiment of the invention.
Figure 61:
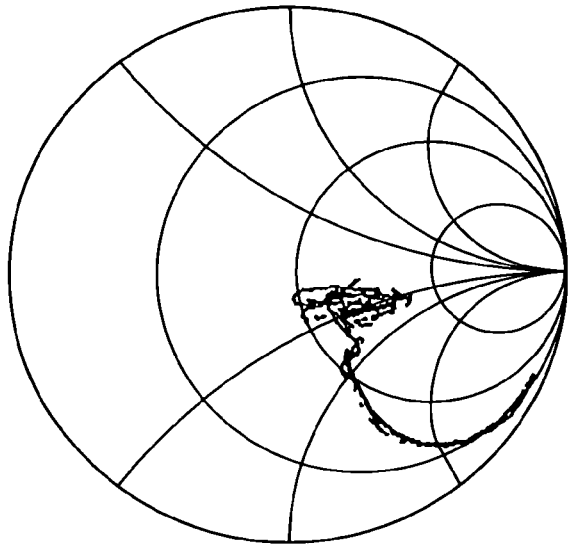
FIG. 61 is a Smith chart showing that another modification of the sixth embodiment of the invention.
Figure 62:
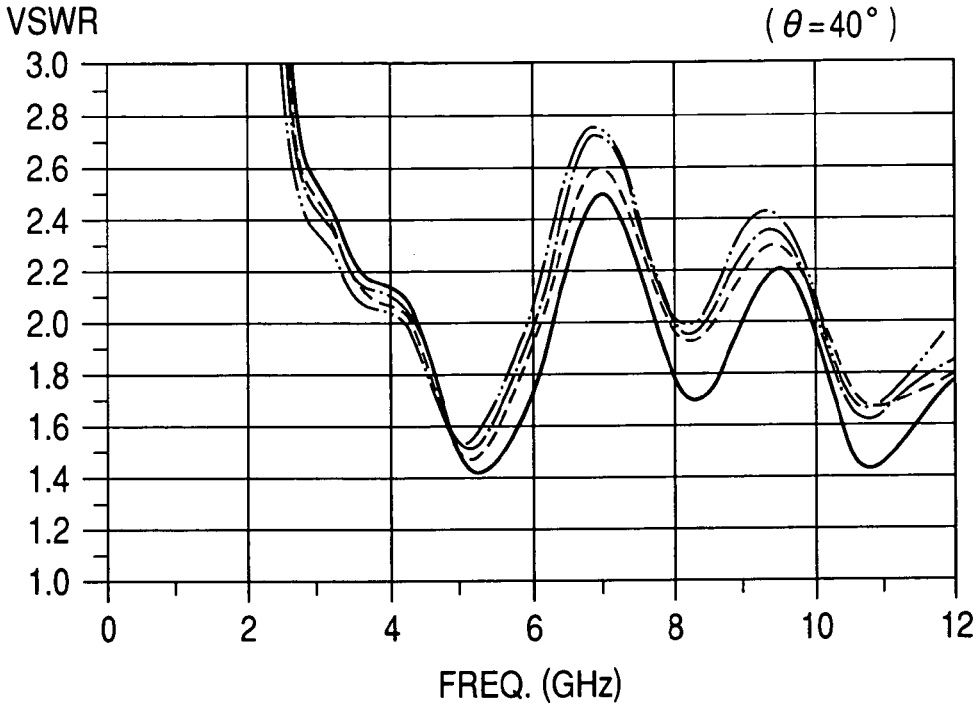
FIG. 62 is a diagram illustrating VSWR characteristics of another modification of the sixth embodiment of the invention.
Figure 63:
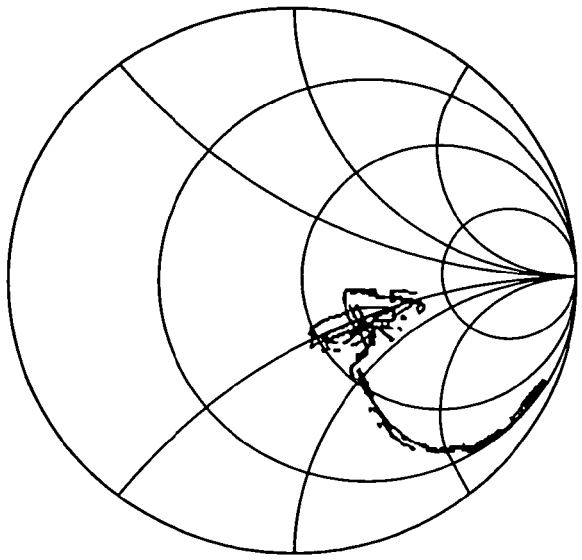
FIG. 63 is a Smith chart showing that another modification of the sixth embodiment of the invention.

On the basis of these results, the examinations are further made on the case, in which the distance d2 was varied from 2.0 mm to 2.6 mm whereas the inclination angle θ was varied from 0 degrees to 40 degrees with the sizes of the radiation portion 620 and the substrate 610 being unvaried. As a result, there were obtained the VSWR characteristics and the Smith charts, as shown in FIG. 58 to FIG. 63. FIG. 59, FIG. 61 and FIG. 63 are diagrams showing the VSWR characteristics and the Smith charts of the cases, in which the inclination angles were 0 degrees, 20 degrees and 40 degrees. Solid curves, broken curves, single-dotted curves and the double-dotted lines indicate the cases, in which the distance d2 was 2.0 mm, 2.2 mm, 2.4 mm and 2.6 mm, respectively. Moreover, FIG. 64 indicates the upper and lower limit frequencies suitable for use, as obtained from those results.

As shown in FIG. 58 to FIG. 63, it is found that the VSWR characteristics were the better for the shorter distance d2 but the worse for the low frequency band. As shown in FIG. 64, it is found that the lower limit frequency becomes the lower for the larger inclination angle in case the distance d2 is fixed, but that the VSWR characteristics becomes worse for the high frequency band. From the viewpoint of satisfying the condition of VSWR<2.5 for the wide band from the lower limit frequency of 3,100 MHz to the upper limit frequency of 10,600 MHz, on the other hand, it is found that the distance d2 is suitable within a range of 2.2 mm to 2.6 mm, more preferably within a range of 2.2 mm to 2.4 mm, and that the inclination angle θ is desired with in a range of 0 degrees to 20 degrees. In other words, a satisfactory result is obtained, if the electrode 660 is formed in such a radial shape as has a center angle ϕ of 140 degrees (180−20×2) degrees or more to 180 degrees (180−0×2) or less with respect to a straight line directed from the electrode 664 (or one end of the electrode 660) or the feeding point toward the opposed electrode 665 (or the other end of the electrode 660).

Figure 65:
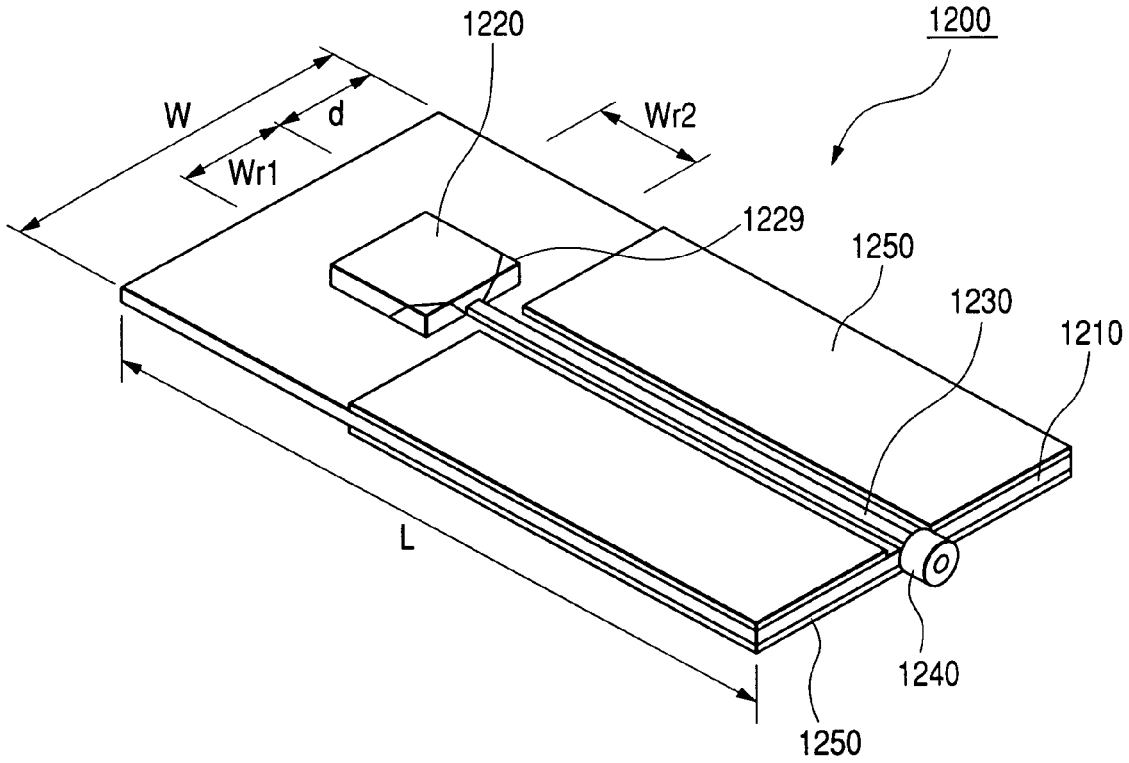
FIG. 65 is a perspective view showing an antenna device 1200 according to a twelfth embodiment of the invention in the direction from a radiation portion 1220.
Figure 66:
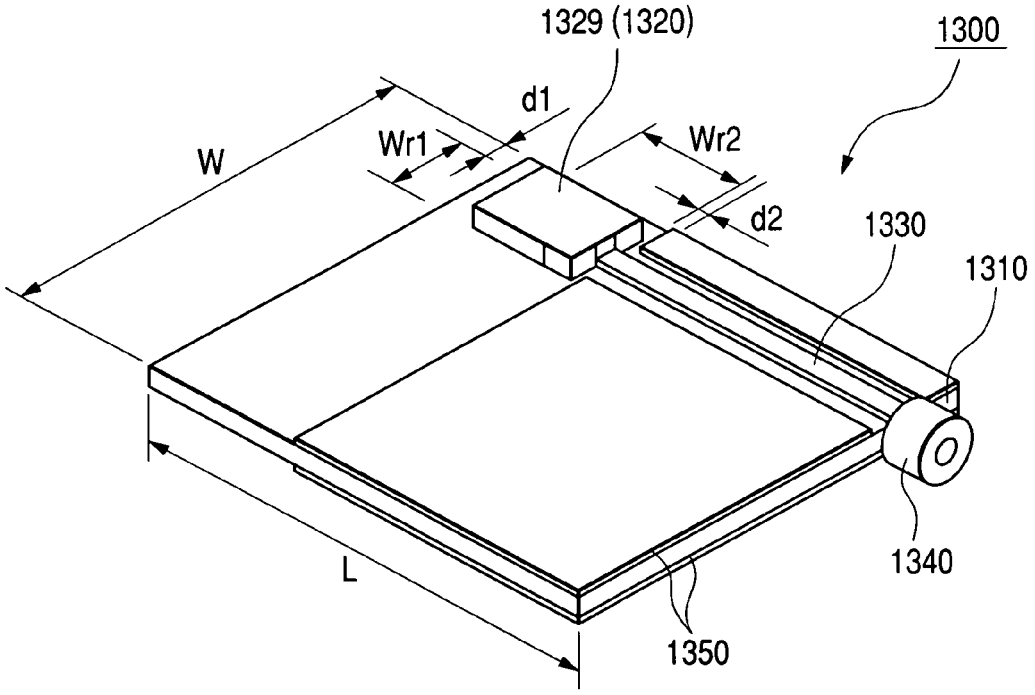
FIG. 66 is a perspective view showing an antenna device 1300 according to a thirteenth embodiment of the invention in the direction from a radiation portion 1320.

Next, twelfth and thirteenth embodiments of the antenna device according to the invention will be described in detail with reference to FIG. 65 and FIG. 66. FIG. 65 and FIG. 66 are perspective views showing an antenna device 1200 according to the twelfth embodiment of the invention and an antenna device 1300 according to the thirteenth embodiment of the invention, respectively, in the arrangement directions of the radiation conductors.

As shown in FIG. 65 and FIG. 66, the antenna devices 1200 and 1300 are constructed to include: base portions 1229 and 1329 for constructing radiation portions 1220 and 1320 arranged on the principal faces of substrates 1210 and 1310; feeder lines 1230 and 1330 for inputting and outputting send-receive signals from and to the radiation portions 1220 and 1320; feeder connectors 1240 and 1340 for connecting the not-shown feeder wires with the feeder lines 1230 and 1330; and grounding conductors 1250 and 1350 formed both on the regions of the principal faces of the substrates 1210 and 1310 along the feeder lines 1230 and 1330 and on the other principal faces, respectively. In short, the twelfth and thirteenth embodiments shown in FIG. 65 and FIG. 66 are modified by substituting coplanar lines for the micro-strip lines as the feeder lines 130 and 630 in the first and sixth embodiments shown in FIG. 1 and FIG. 14.

According to the invention, as shown in FIG. 65 and FIG. 66, miniature wideband antenna characteristics can be obtained even if the feeder lines 1230 and 1330 of the antenna devices 1200 and 1300 are replaced by the coplanar lines.

In the embodiments thus far described, the base portion of the dielectric member was given the easily manufactured column shape. However, an antenna electrode of a stereoscopic shape may also be constructed by molding the base portion into a circular column shape, a conical shape, a polygon such as a regular tetrahedron or dodecahedron, a cube or an ellipsoid, and by forming the electrodes on the base portion molded. Moreover, the base portion may be shaped to have cavities inside. In the foregoing embodiments, the mono-pole structure was adopted to reduce the occupation area. However, two identical antenna devices may also be arranged at two mirror image positions to make a dipole antenna. Moreover, the feeder line should not be limited to the micro-strip line or the coplanar line but may be a strip line.

Although the invention has been described on its embodiments, it should not be limited to them in the least. It is, however, natural that the invention could be practiced in further various modes without departing from its gist. For example, the antenna electrode could be made of copper or aluminum. Moreover, this antenna device could be used not only in the LAN device housed in the IC card but also as the antenna for the mobile telephone.

This application is based on Japanese Patent application JP 2003-196496, filed Jul. 14, 2003, and Japanese Patent application JP 2004-179987, filed Jun. 17, 2004, the entire contents of which are hereby incorporated by reference, the same as if set forth at length.

What is claimed is:

1. An antenna device comprising:

a substrate;

a radiation portion including a dielectric block arranged on a first principal face of said substrate and a first conductor layer formed in a stereoscopic shape on a surface of said dielectric block; and a grounding conductor including a second conductor layer provided on a second principal face of said substrate opposed to the first principal face, wherein said grounding conductor is provided on a partial region of said second principal face of said substrate, and said radiation portion is arranged on said first principal face of the substrate such that the radiation portion is not disposed over the partial region of the second principal face of the substrate on which the grounding conductor is provided.

2. The antenna device according to claim 1, further comprising a feeder line extending over the first principal face of said substrate, from a feeder portion disposed at an end of said first conductor layer.

3. The antenna device according to claim 1, wherein said first conductor layer is provided on at least three faces of the surface of said dielectric block except a contact face that contacts said substrate.

4. The antenna device according to claim 3, wherein said first conductor layer is provided continuously at a portion of said contact face of said dielectric block that contacts said substrate.

5. The antenna device according to claim 1, wherein said first conductor layer is provided on a contact face said dielectric block that contacts said substrate and faces of the dielectric block that are adjacent to said contact face.

6. The antenna device according to claim 1, wherein said first conductor layer is provided in a radial shape from a feeder portion disposed at a first end of said first conductor layer toward a second end of said first conductor layer.

7. The antenna device according to claim 1, wherein said first conductor layer is provided in a radial shape from a feeder portion disposed at an edge portion of said first conductor layer away from a region having said grounding conductor formed thereon.

8. The antenna device according to claim 1, wherein said dielectric block includes at least one of alumina, calcium titanate, magnesium titanate and barium titanate.

9. The antenna device according to claim 1, wherein said dielectric block has a specific dielectric constant of 15 or less.

10. The antenna device according to claim 1, wherein said first conductor layer is provided in a radial shape having a center angle of 80 degrees or more and 180 degrees or less with respect to a straight line joining a feeder portion disposed at a first end of said first conductor layer and a second end of said first conductor layer.

11. The antenna device according to claim 2, wherein said grounding conductor is further provided along said feeder line on the first principal face of said substrate, and said feeder line constructs a coplanar line.

12. An antenna device comprising:

an antenna element including: a substrate; a radiation portion including a dielectric block arranged on a first principal face of said substrate, and a first conductor layer provided in a stereoscopic shape on a surface of said dielectric block; a grounding conductor including a second conductor layer formed on a second principal face of said substrate opposed to the first principal face; and a feeder line extending over the first principal face of said substrate from a feeder portion disposed at an end of said first conductor layer, wherein said grounding conductor is provided on a partial region of the second principal face of said substrate, and said radiation portion is arranged on said first principal face of the substrate such that the radiation portion is not provided over the partial region of the second principal face of the substrate on which the grounding conductor is provided.

13. The antenna device according to claim 12, wherein said radiation portion is arranged closer to either one side of said substrate in a direction along a side portion of said grounding conductor opposed to said radiation portion across said substrate.

14. The antenna device according to claim 12, wherein said first conductor layer is provided on at least three faces of the surface of said dielectric block and is not provided on at least one contact face that contacts said substrate.

15. The antenna device according to claim 14, wherein said first conductor layer is provided continuously at a portion of a contact face of said dielectric block that contacts said substrate.

16. The antenna device according to claim 12, wherein said first conductor layer is formed on a contact face of said dielectric block that contacts said substrate and is formed on faces of the dielectric block that are adjacent to said contact face.

17. The antenna device according to claim 12, wherein said first conductor layer is provided in a radial shape from a feeder portion disposed at a first end of said first conductor layer toward a second end of said first conductor layer.

18. The antenna device according to claim 12, wherein said first conductor layer is provided in a radial shape from a feeder portion disposed at an edge portion of said first conductor layer away from a region having said grounding conductor formed thereon.

19. The antenna device according to claim 12, wherein said dielectric block includes at least one of alumina, calcium titanate, magnesium titanate and barium titanate.

20. The antenna device according to claim 12, wherein said dielectric block has a specific dielectric constant of 15 or less.

21. The antenna device according to claim 12, wherein said first conductor layer is provided in a radial shape having a center angle of 80 degrees or more and 180 degrees or less with respect to a straight line joining a feeder portion disposed at a first end of said first conductor layer and a second end of said first conductor layer.

22. The antenna device according to claim 12, wherein said grounding conductor is further provided along said feeder line on the first principal face of said substrate, and said feeder line constructs a coplanar line.

23. A method for manufacturing an antenna device, comprising:

a step of forming a dielectric member into a predetermined shape;

a step of forming a feeding electrode as an antenna feeding portion at a predetermined portion of said dielectric member;

a step of forming a first conductor layer on a surface of said dielectric member so that said first conductor layer is entirely formed into a stereoscopic shape from a position of said feeding electrode disposed at a first end of said dielectric member; and a step of arranging said dielectric member having said first conductor layer formed thereon on a first principal face of a substrate, and arranging a grounding conductor including a second conductor layer on a second principal face of said substrate, wherein said grounding conductor is provided on a partial region of said second principal face of said substrate, and said dielectric member is arranged on said first principal face of the substrate such that the dielectric member is not disposed over the partial region of the second principal face of the substrate on which the grounding conductor is provided.

* * * * *